US010737190B2

(12) United States Patent
Lee et al.

(10) Patent No.: US 10,737,190 B2
(45) Date of Patent: Aug. 11, 2020

(54) SMART TOY PLATFORM

(71) Applicant: CREAMO Inc., Seoul (KR)

(72) Inventors: Seok Lee, Seoul (KR); Taikjin Lee, Seoul (KR); Hyunduk Kim, Cheonan-si (KR); Jeong Hun Shin, Daegu (KR); Won Kyo Jeong, Daegu (KR); Soo Jung Hur, Daegu (KR); Yong-Joon Park, Seongnam-si (KR); Deokha Woo, Seoul (KR)

(73) Assignee: CREAMO INC., Seoul (KR)

( * ) Notice: Subject to any disclaimer, the term of this patent is extended or adjusted under 35 U.S.C. 154(b) by 0 days.

(21) Appl. No.: 15/944,082

(22) Filed: Apr. 3, 2018

(65) Prior Publication Data

US 2019/0299113 A1 Oct. 3, 2019

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01)

(58) Field of Classification Search
CPC ..... A63H 33/08; A63H 33/042; A63H 33/086
USPC ..... 446/90, 91
See application file for complete search history.

(56) References Cited

U.S. PATENT DOCUMENTS 6,585,553 B1 * 7/2003 Fetridge ..... A63H 33/042 446/124
6,773,323 B1 * 8/2004 Huang ..... A63H 31/00 446/103
8,079,890 B2 * 12/2011 Seligman ..... A63H 33/086 446/118
9,017,132 B2 * 4/2015 Lin ..... A63H 33/086 446/91
9,168,464 B2 * 10/2015 Karunaratne ..... A63H 33/086
9,561,447 B2 * 2/2017 Karunaratne ..... A63H 33/086
2003/0148700 A1 * 8/2003 Arlinsky ..... A63H 33/04 446/91
2004/0092207 A1 * 5/2004 Hansen ..... A63H 30/04 446/454
2006/0252340 A1 * 11/2006 Bach ..... A63H 33/042 446/124
2011/0151743 A1 * 6/2011 Munch ..... A63H 33/042 446/91
2013/0217295 A1 * 8/2013 Karunaratne ..... A63H 33/086 446/124

(Continued)

FOREIGN PATENT DOCUMENTS

KR 10-2005-0054895 A 6/2005
KR 10-1516807 B1 5/2015

*Primary Examiner* — Joseph B Baldori
(74) *Attorney, Agent, or Firm* — Rabin & Berdo, P.C.

(57) ABSTRACT

A smart toy platform includes a body including a top part, a bottom part, and a plurality of side parts, a function unit coupled to at least one of the plurality of side parts an application unit arranged in the body and to control an operation of the function unit, a base unit arranged in the body and to provide an application support function to the application unit, and a power supply unit configured to supply electric power to at least one of the function unit, the application unit, or the base unit. The function unit is coupled to the at least one of the plurality of side parts on an inner side or an outer side, across the inner side and the outer side, or an integrate manner.

6 Claims, 25 Drawing Sheets

(56) References Cited

U.S. PATENT DOCUMENTS

| | | | | |
|---|---|---|---|---|
| 2014/0127965 | A1* | 5/2014 | Adam | A63H 33/042<br>446/91 |
| 2014/0273711 | A1* | 9/2014 | Capriola | A63H 33/042<br>446/91 |
| 2015/0182869 | A1* | 7/2015 | Karunaratne | A63H 33/086<br>446/91 |
| 2016/0361662 | A1* | 12/2016 | Karunaratne | A63H 33/042 |
| 2017/0144083 | A1* | 5/2017 | Kærsgaard et al. | A63H 33/042 |

* cited by examiner

SMART TOY PLATFORM

SPECIFIC REFERENCE TO A GRACE PERIOD INVENTOR DISCLOSURE

This invention has been published as Korean Patent Laid-Open Publication No. 10-2017-0037206 on Apr. 4, 2017, which is now Korean Patent No. 10-1739029.

BACKGROUND

1. Field

The present invention relates to a smart toy platform and an assembly unit set.

2. Description of the Related Art

Some basic building blocks of, for example, the LEGO® block toys feature a structure of parallelepiped shape including engagement projections on one side and complementary engagement recesses on the other side so that the blocks can be assembled together into desired forms. Such structures allow a simple assembly activity to build a variety of objects.

However, the LEGO® product includes fixed colors, sizes, and shapes, and it is an inflexible property. The need for the LEGO® bricks of additional colors, sizes, and shapes necessitates a further purchase of bricks from the same source. Such strict properties may restrict the creativity in toy building activity.

As the Information Technology (IT) has become widespread in recent years, products emerge with combined Internet of Things (IoT) technology. The classic parallelepiped designs of, for example, the LEGO® bricks can employ the IoT technology to be linked to a network for various possible applications.

This brings a need for providing a toy technology that triggers new play and fun through simple exchanges of various functions by combining the IoT technology with toys into different capabilities.

Along with the development in the toy industry using the sophisticated technology, toys come to be in transition from the traditional offering of visual, tactile, and auditory entertainment or action to becoming smart devices utilizing touch, voice, pupil movement, motion detection, etc. Simple and stationary toys of traditional wooden, metal, and plastic materials have developed through convergence and integration with robot, remote control, and imaging technologies and advanced medical technology such as brain and cognitive engineering, evolving further into multidimensional complex, dynamic, and emotional devices. Mainly based on the fundamental industry such as molding, welding, cutting, heat treatment, and surface treatment, the modern advanced toy industry is established through convergence and integration with the integrated circuit (IC) technology, culture technology (CT), robot industry, cultural industry, psychological and/or medical theory, etc.

Recently, different puzzle games have been developed to inform a user of the result of assembly activity upon completing assembly of the pieces of the puzzle. Korean Registered Utility Model No. 270,724 describes a technique for detecting whether interlocked puzzle pieces are completely assembled, which includes a material having electrical conductivity on the respective puzzle pieces so that an electric transmission path is established when the puzzle pieces are fully assembled at their designated positions. This allows electric signals generated from one side of the electric transmission path to pass therethrough to the other side of the transmission path, to exhibit that assembly of the puzzle game has been completed. This implements the notification function wherein the complete assembly of the puzzle game supplies the electric power from one side, to notify by voice or other media on the other side that the assembly is complete.

SUMMARY

According to at least one embodiment of the present invention, a smart toy platform includes a body including a top part, a bottom part, and a plurality of side parts, a function unit configured to be coupled to at least one of the plurality of side parts, an application unit configured to be arranged in the body and to control an operation of the function unit, a base unit configured to be arranged in the body and to provide an application support function to the application unit, and a power supply unit configured to supply electric power to at least one of the function unit, the application unit, or the base unit. The plurality of side parts includes at least a first side part, a second side part, and a third side part. The function unit is configured to be coupled to the at least one of the plurality of side parts on an inner side or an outer side, across the inner side and the outer side, or an integrate manner.

According to at least one embodiment of the present invention, an assembly unit set includes a trigger block configured, upon being coupled to another block, to switch to a standby mode, and upon sensing a specific signal in the standby mode, to output a trigger signal and a driving block configured, upon being coupled to another block, to switch to a standby mode, and upon receiving the trigger signal from the trigger block in the standby mode, to perform a predetermined operation. Each of the trigger block and the driving block includes a body including a top part, a bottom part, and a plurality of side parts, a function unit configured to be coupled to at least one of the plurality of side parts, an application unit configured to be arranged in the body and to control an operation of the function unit, a base unit configured to be arranged in the body and to provide an application support function to the application unit, and a power supply unit configured to supply electric power to at least one of the function unit, the application unit, or the base unit, wherein the top part includes a first coupling element, the bottom part includes a second coupling element, the plurality of side parts includes at least a first side part, a second side part, and a third side part, the function unit is configured to be coupled to the at least one of the plurality of side parts on an inner side or an outer side, across the inner side and the outer side, or an integrate manner. The trigger block is configured to output the trigger signal in a broadcasting manner using a plurality of channels. A plurality of driving blocks is configured to receive the trigger signal via a single channel. Upon receiving the trigger signal via the single channel, the plurality of driving blocks is configured to perform respective operations by group.

The above and other objects, features, advantages and technical and industrial significance of this invention will be better understood by reading the following detailed description of presently preferred embodiments of the invention, when considered in connection with the accompanying drawings.

BEST MODE(S) FOR CARRYING OUT THE INVENTION

Figure 1:
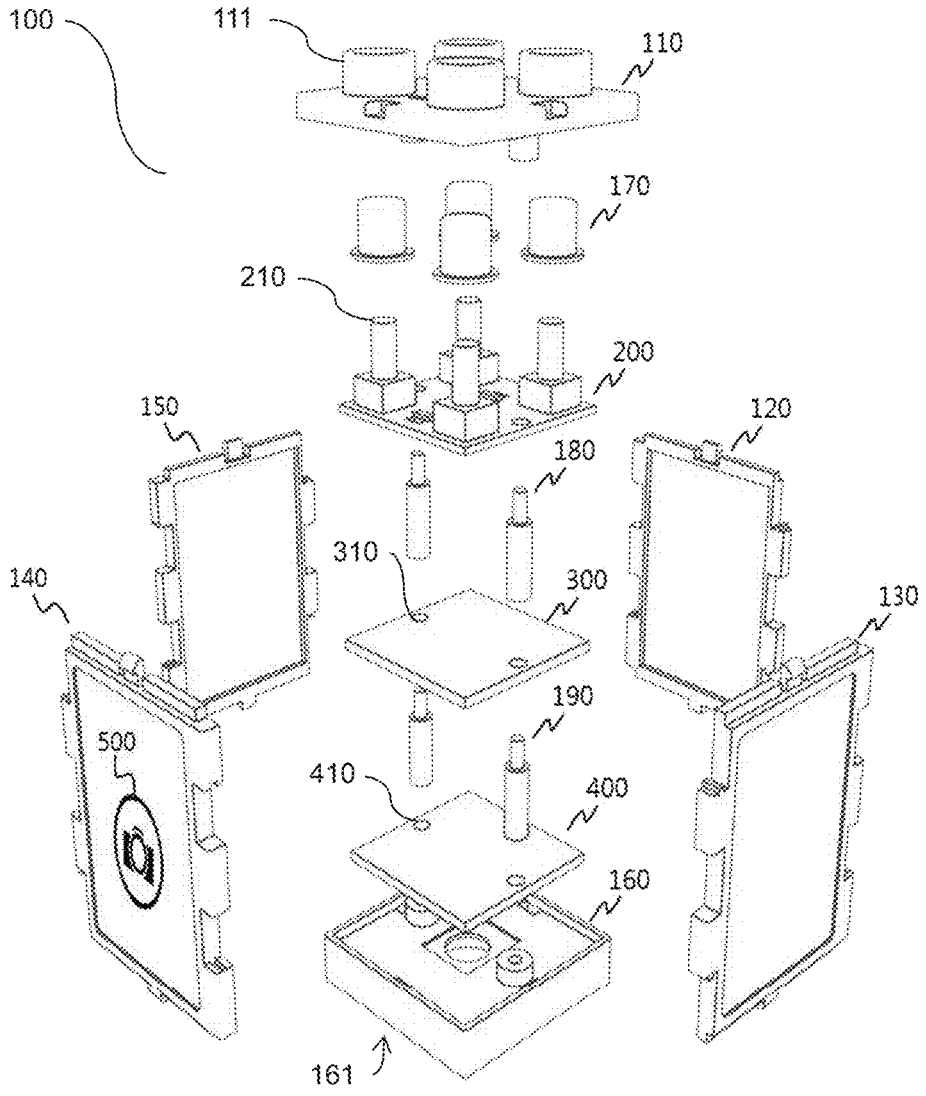
FIG. 1 is an exploded perspective view of a smart toy platform according to some embodiments of the present invention.

Exemplary embodiments of the present disclosure are described in detail below with reference to the accompanying drawings. In the following descriptions, like reference numerals designate like elements although the elements are shown in different drawings. Further, detailed descriptions of known functions and configurations incorporated herein are omitted for the purpose of clarity and for brevity.

FIG. 1 is an exploded perspective view of a smart toy platform 100 according to some embodiments of the present invention.

As shown in FIG. 1, a smart toy platform 100 according to some embodiments includes a body, a base unit 200, an application unit 300, a power supply unit 400, and a function unit 500.

It is a mere example that the body of the smart toy platform 100 includes a top part 110, a bottom part 160, and one or more side parts. It is a mere example that the body includes the top part 110, the bottom part 160, and one or more side parts, but the present invention is not limited thereto. In another embodiment, the body may be a ball-like sphere, it may be an elliptical sphere, or it may be a polyhedron with multiple faces, but it is not limited thereto.

For the sake of convenient explanation, the illustrative body is of parallelepiped shape as an example, wherein the one or more side parts according to at least one embodiment includes a front part 140, a rear part 120, a left side part 150, and a right side part 130, as shown in FIG. 1.

The top part 110, bottom part 160, front part 140, rear part 120, left side part 150, and right side part 130 constituting the main body have fitting grooves and fitting projections respectively. The fitting grooves and the fitting projections are engaged, to enable above parts to be attached to or detached from each other.

According to at least one embodiment of the present invention, a plurality of smart toy platforms 100 has at least one mating projection 111 formed on the top part 110 and a mating groove 161 to which a mating projection 111 is coupled to the bottom part 160.

The body forms the outer contour of the smart toy platform 100. The body can support a base unit 200, an application unit 300, a power supply unit 400, and a function unit 500. The main body may have a shape distinguished between the inside and the outside. The base unit 200, the application unit 300, and the power supply unit 400 may be located inside the body. The function unit 500 may be located inside or outside of the body, across the inside and outside of the body, or may be integrated with parts constituting the body.

In some embodiments, the base unit 200 is coupled to the top part 110 by using one or more knobs 170. On the surface of the base unit 200 are formed projections 210 coupled to the knobs 170, the projections 210 being coupled to the knobs 170 which are coupled to the top part 110, and thereby the base unit 200 is coupled to the top part 110.

The base unit 200 provides basic functions of the smart toy platform 100. The above basic functions may include support for applications provided to the application unit 300. The application support includes any one of a power supply and a communication function. The power supply is a function of supplying power to the application unit. The communication function includes a wired/wireless communication function in which the application unit 300 can communicate with an external device. The wired communication function included in the communication function may be serial communication including one of UART (RS232-C), USB (Universal Serial Bus), SATA, and IEEE 1294. The wireless communication function included in the communication function may be wireless communication using any one of WiFi, Zig-bee, 3G, 4G, LTE, and RF communication.

In some embodiment, the application unit 300 and the function unit 500 provide functions unique to the smart toy platform 100. For example, when the function unit 500 includes a camera module capable of taking pictures and videos. The application unit 300 controls the camera module to process photos and videos taken by the camera module, so that the smart toy platform 100 becomes a toy with image capturing functions.

In some embodiment, the application unit 300 uses one or more first supports 180 to couple to the base unit 200. On the surface of the application unit 300, a groove 310 may be formed to be coupled with the first support 180. The application unit 300 may be coupled to the base unit 200 by coupling the groove 310 with the first support 180 and coupling the first support 180 to the base unit 200.

Though it is not shown in FIG. 1, the application unit 300 and the base unit 200 may be connected to at least one of a power supply line (not shown) and a data transmission line (not shown). Through the power supply line, the base unit 200 may supply power to the application unit 300, and the application unit 300 and the base unit 200 can mutually transmit and receive the control signal and the data signal via the data transmission line.

In some embodiment, the function unit 500 includes modules that perform specific functions. The function unit 500 may include at least one of a camera module, an audio output module, a light emitting module, a sensor module, a motor module, an image display module, and an input module. The sound output module includes a speaker. The light emitting module includes light emitting means. The sensor module includes at least one of a touch sensor, a temperature sensor, a humidity sensor, a light sensor and a touch pad. The image display module includes any one of an LCD module, an LED module, an electronic ink module and a CRT module. The input module includes any one of a keypad module, a switch module, and a microphone module.

The function unit 500 may be coupled to at least one of the parts included in the body of the smart toy platform 100. The function unit 500 may be a toy having the function provided by the function unit 500 by attaching/detaching the above parts or combining the parts incorporating the function unit 500 with the main body.

The function unit 500 and the application unit 300 may be connected to at least one of a power supply line (not shown) and a data transmission line (not shown). Through the power supply line, the application unit 300 can supply power to the function unit 500. Through the data transmission line, the application unit 300 and the function unit 500 can mutually transmit and receive the control signal and the data signal.

The application unit 300 and the first support 180 can be detachably coupled. For example, when a first application unit, which controls a first function unit including a imaging camera module, is attached to the smart toy platform 100, separating the first function unit and attaching the second application unit controlling the second function unit including the audio recording module to the base unit 200 allow to switch the function of the smart toy platform 100 from the photographing function to the recording function.

An advantage of at least one embodiment of the present invention is that smart toy platform 100 can be modified into a toy to perform new functions by attaching and detaching the application unit 300 and the function unit 500 of smart toy platform 100.

The power supply unit 400 can provide power to any of the base unit 200, the application unit 300, and the function unit 500. The power supply unit 400 may include a battery. The battery may be rechargeable or disposable. The disposable battery may be detachable to the power supply unit 400.

Although not shown in FIG. 1, the power supply unit 400 connects via a power supply line (not shown) with one of the base unit 200, the application unit 300, and the function unit 500 in order to supply power.

By way of example, the power supply unit 400 may be coupled to the application unit 300 by utilizing one or more second supports 190. The lower part of the power supply unit 400 may be coupled to the bottom part 160. The surface of the power supply unit 400 may be formed with a groove 410 to be coupled with the second support 190. The power supply unit 400 may be coupled to the application unit 300 by coupling the groove 410 with the second support 190 and coupling the second support 190 to the application unit 300. The coupling position of the power supply unit 400 is merely illustrative, and is not limited thereto.

The coupling order and arrangement between the base unit 200, the application unit 300, and the power supply unit 400 shown in FIG. 1 are illustrative and are not limited thereto. In another example, the power supply unit 400 may also be coupled with the base unit 200 without involving the application unit 300.

According to some embodiments of the present invention, the base unit 200 and the power supply unit 400 are integrally constructed.

According to some embodiments of the present invention, when the base unit 200 includes a separate power supply module, the power supply unit 400 may not be included in the smart toy platform 100.

According to some embodiments of the present invention, the base unit 200, the application unit 300, and the function unit 500 may include respective power supply modules. The power supply unit 400 may not be included in the smart toy platform 100.

Figure 2:
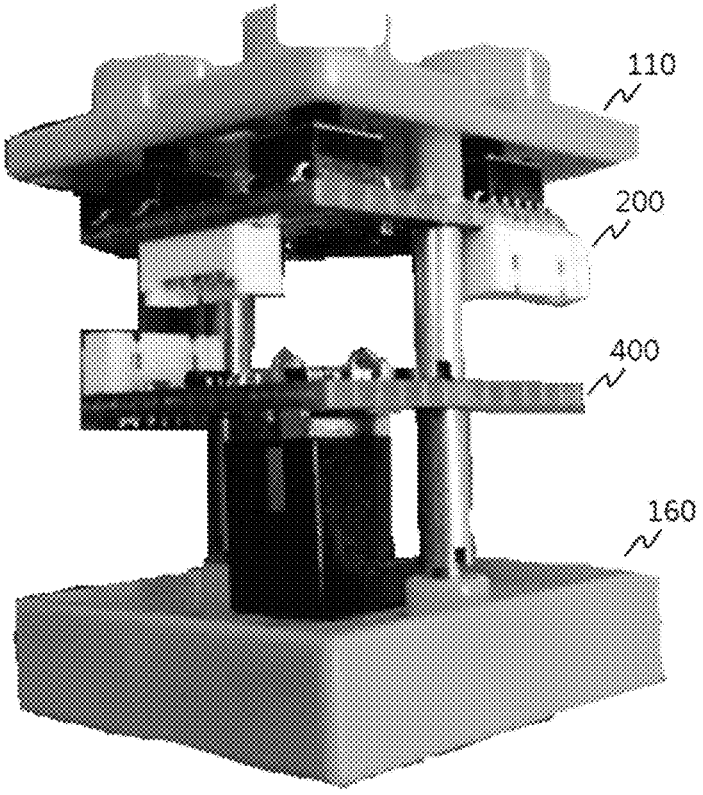
FIG. 2 is an internal perspective view of a smart toy platform according to some embodiments of the present invention.

FIG. 2 is an internal perspective view of the smart toy platform 100 according to some embodiments of the present invention.

The smart toy platform 100 in FIG. 2 shows a state in which the application unit 300 and the function unit 500 are separated.

In order to attach the application unit 300 and the function unit 500, the front part 140, the rear part 120, the right side part 130, and the left side part 150 can be separated from the body. With all sides being open, the application unit 300 can be coupled and mounted between the base unit 200 and the power supply unit 400. After the application unit 300 is installed, the part incorporating the function unit 500 can be coupled between the top part 110 and the bottom part 160.

Figure 3:
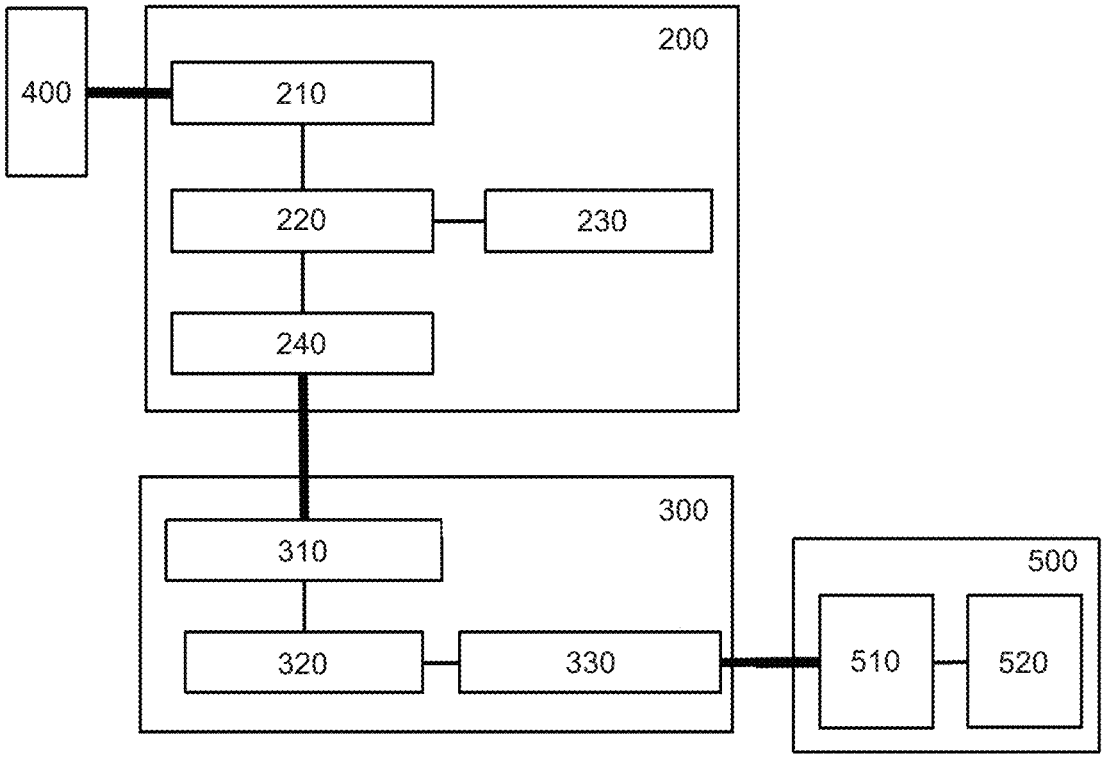
FIG. 3 is a block diagram of a smart toy platform according to some embodiments of the present invention.

FIG. 3 is a block diagram of the smart toy platform 100 according to some embodiments of the present invention.

Referring to FIG. 3, each configuration of the smart toy platform 100 according to at least one embodiment of the present invention will be described in detail.

According to at least one embodiment of the present invention, the base unit 200 may include a power supply connector 210, a base controller 220, a communication unit 230 and an application unit connector 240.

The power supply connector 210 receives power from the power supply unit 400. For example, the power supply connector 210 may be a connector, and a power supply line (not shown) connected to the power supply unit 400 may be connected to the connector.

The application unit connector 240 connects the application unit 300 and the base unit 200. The connection configuration may include one of a power supply line (not shown) for supplying power to the application unit 300 and a data transmission line (not shown) for data transmission/reception.

The communication unit 230 may transmit the data supplied to the base controller 220 to the outside, receive data from the outside, and provide the received data to the base controller 220.

The communication unit 230 can handle wired communication or wireless communication. The wired communication may be a serial communication including one of UART (RS 232-C), USB (Universal Serial Bus), SATA, and IEEE 1294. The wireless communication may be wireless communication using any one of WiFi, Zig-bee, 3G, 4G, LTE, and RF communication. The communication unit 230 may include a connector (not shown) for wired communication or an antenna (not shown) for notifying wireless communication.

The base controller 220 controls the power supply to the application unit 300 and processes the data transmission/reception request of the application unit 300.

According to at least one embodiment of the present invention, when the application unit 300 is connected to the application unit connector 240, the base controller 220 transmits the power provided from the power supply connector 210 to the application unit connector 240, so as to energize the application unit 300.

According to at least one embodiment of the present invention, the base controller 220 may receive a data transfer request from the application unit 300 via the application unit connector 240, and transmits the data contained in the received data transfer request to a communication unit 230 and send it to the outside. Conversely, the base controller 220 may provide the data provided from the communication unit 230 to the application unit 300 via the application unit connector 240.

For example, the function unit 500 includes a camera module, and the application unit 300 may transmit data of the image photographed by the function unit 500 to the base unit 200 in order to transmit it to the outside. The base unit 200 may receive the image data and transmit it to the outside via the communication unit 230.

As a function of the base controller 220, power supply and data transmission and reception have been illustrated, but the function of the base controller 220 is not limited to this.

According to at least one embodiment of the present invention, the application unit 300 may include a base unit connector 310, an application controller 320, and a function unit connector 330.

The base unit connector 310 connects the application unit 300 and the base unit 200. The connection configuration may include one of a power supply line (not shown) for receiving power supply from the base unit 200 and a data transmission line (not shown) for data transmission/reception. Through these connection configurations, the base unit connector 310 and the application unit connector 240 are connected.

The application controller 320 can control the function unit 500. The application controller 320 may enable or disable the function unit 500 and process data provided from the function unit 500 based on the function of the function unit 500. For example, when the function of the function unit 500 is image capturing, the above data can be transferred to the base unit 200 in order to transmit the data provided from the function unit 500 to the outside.

The function unit connector 330 connects the application unit 300 and the function unit 500. The connection configuration can include one of a power supply line (not shown) for supplying power to the function unit 500 and a data transmission line (not shown) for data transmission/reception. The function unit connector 330 and the control connector 510 are connected by using the connection configuration.

The function unit connector 330 may be connected to one or more function units 500. Alternatively, the application unit 300 may be connected to one or more function units 500 including one or more function unit connectors 330. When one application unit 300 is connected to one or more function units 500, all connected function units 500 can be controlled.

According to at least one embodiment of the present invention, the function unit 500 may include a control connector 510 and a function unit 520.

The control connector 510 connects the function unit 500 and the application unit 300. The connection configuration may include one of a power supply line (not shown) for receiving power supply from the application unit 300 and a data transmission line (not shown) for data transmission/reception. The control connector 510 and the function unit connector 330 are connected via the connection configuration.

The function unit 520 performs a function of a specific purpose. In some embodiments, the function unit 520 includes at least one of a camera module, a sound output module, a light emission module, a sensor module, a motor module, an image display module, and an input module, to perform the specific purpose.

The sound output module includes a speaker. The light emitting module includes a light emitting element. The sensor module may include at least one of a touch sensor, a temperature sensor, a humidity sensor, a light sensor, and a touch pad. The image display module may include any one of an LCD module, an LED module, an electronic ink module, and a CRT module. The input module may include any one of a keypad module, a switch module and a microphone module.

The function unit 520 may include one or more of the plurality of modules. For example, it can include both a camera module and an image display module, and images captured by the camera module can be displayed on the image display module.

Figure 4:
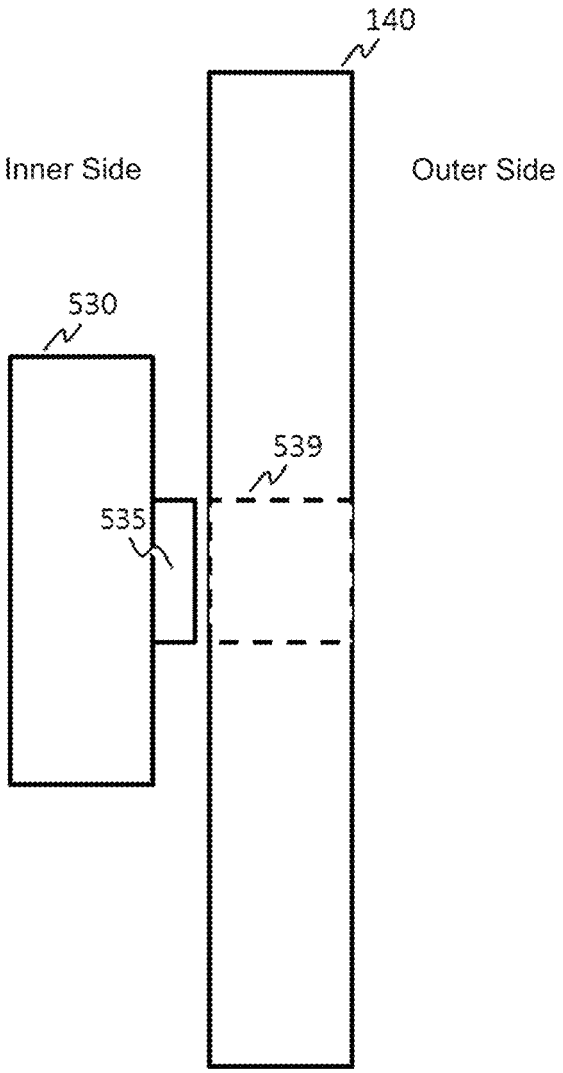
FIGS. 4 to 6 are schematic diagrams for illustrating coupling of a function unit to a part of a smart toy platform according to some embodiments of the present invention.
Figure 5:
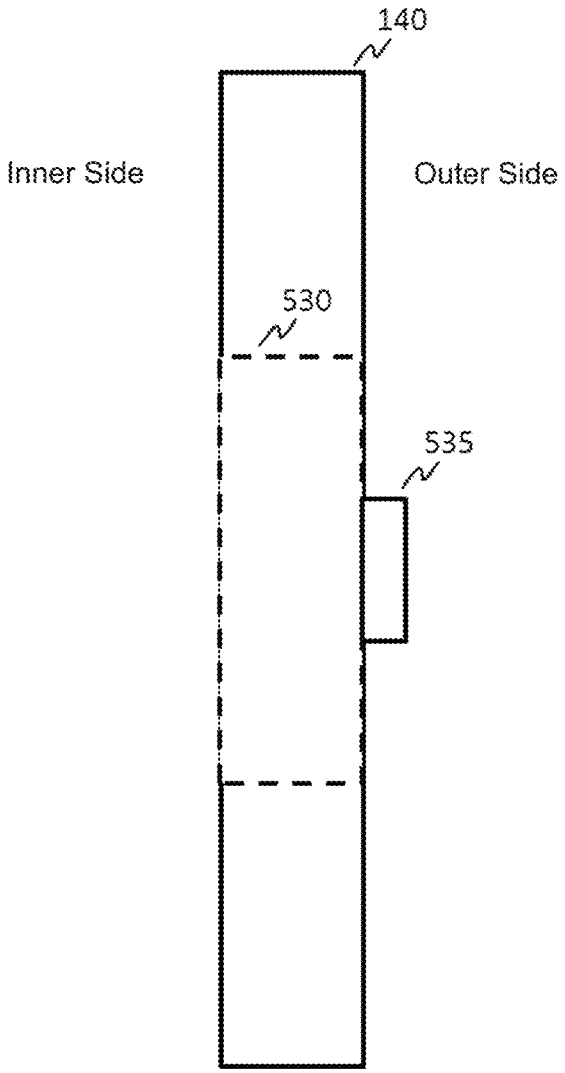
Figure 6:
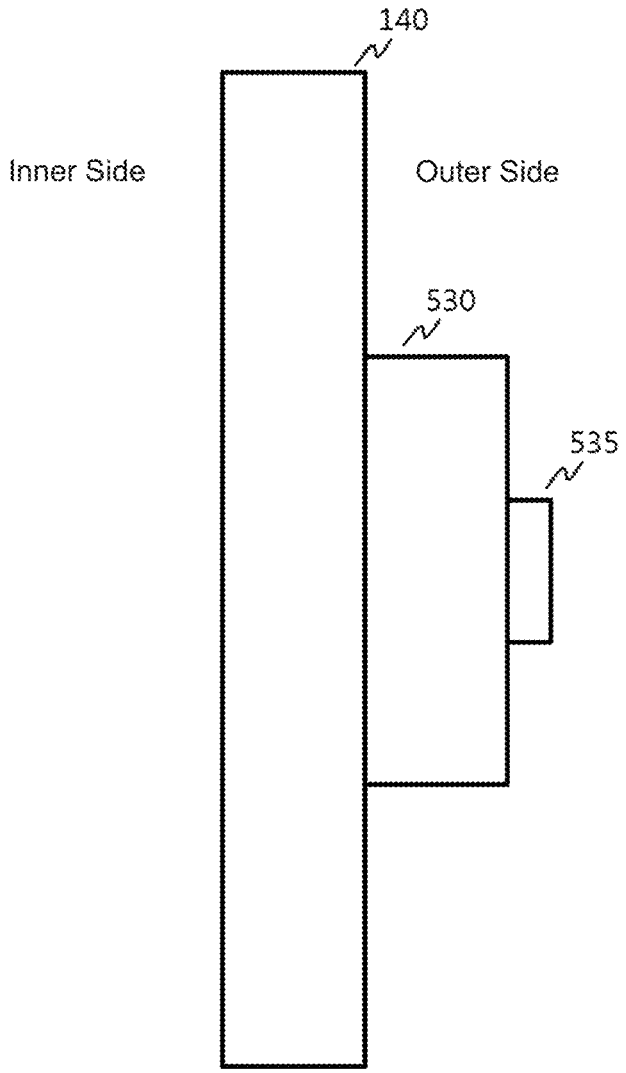

FIGS. 4 to 6 are schematic diagrams for illustrating coupling of the function unit 500 to a part of the smart toy platform 100 according to some embodiments of the present invention.

As shown in FIGS. 4 to 6, the function unit 500 may be coupled to any of the parts constituting the main body of the smart toy platform 100. The smart toy platform 100 can be distinguished between inside and outside. The function unit 500 may be coupled to the inner side surface or the outer side surface of the smart toy platform 100, or it can be formed integrally with the above parts.

For the sake of convenience of explanation, FIGS. 4 to 6 illustrate that the function unit 500 is a camera module, and the front part 140 is configured to be coupled with the function unit 500, but this is illustrated as an example, and it is not limited to this. The function unit 500 may be coupled to at least one of the front part 140, rear part 120, left side part 150, right side part 130, top part 110, and bottom part 160. The camera module may include a main camera module body 530 and a lens unit 535.

As shown in FIG. 4, the function unit 500 can be coupled to the inner surface of the front part 140. When the function unit 500 is a camera module and the function unit 500 is coupled to the inner side of the front part 140, the front part 140 may be formed with a light receiving channel 539 through which light can pass. The function unit 500 may be coupled to the front part 140 so that the central axis of the lens unit 535 coincides with that of the light receiving channel 539.

As shown in FIG. 5, the function unit 500 may be integrated with the front part 140. A part of the function unit 500 may be coupled so as to be recessed in the front part 140 or the function unit 500 may be coupled across inside and outside the front part 140.

As shown in FIG. 6, the function unit 500 may be coupled to the outer surface of the front part 140. When the function unit 500 is a camera module, the back side of the module body 530 may be coupled onto the outer side of the front part 140.

FIGS. 7 to 11 are schematic diagrams for illustrating example usages of the smart toy platform 100 according to some embodiments of the present invention.

Figure 7:
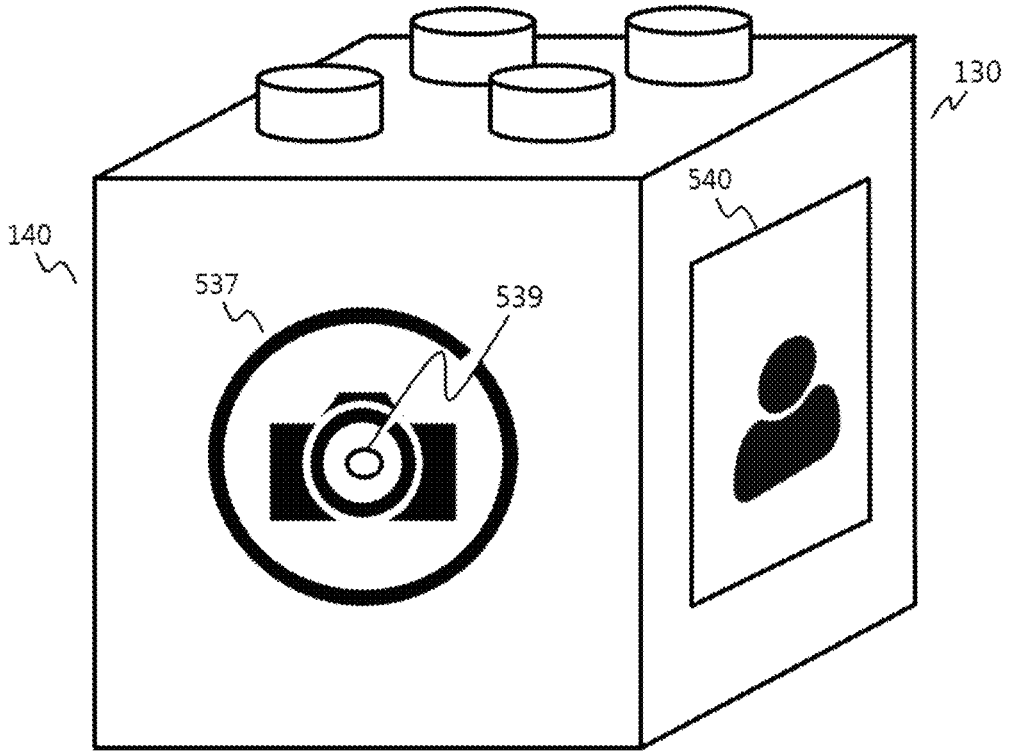
FIGS. 7 to 11 are schematic diagrams for illustrating usage of a smart toy platform according to some embodiments of the present invention.

Referring to FIG. 7, the smart toy platform 100 according to at least one embodiment of the present invention includes a first function unit and a second function unit. The first function unit includes a camera module coupled to an inner side of the front part 140, and the second function unit includes an image display module 540 coupled to the outer side of the right side part 130. The smart toy platform 100 may include a first application unit that controls the first function unit, and a second application unit that controls the second function unit. The first application unit and the second application unit may be the same or different application units.

A camera module icon 537 indicating a camera module may be printed on the outer surface of the front part 140 to which the first function unit is coupled, and the light receiving channel 539 may be formed in the front part 140. The first function unit can capture an image based on the light entering the light receiving channel 539. The first application unit that controls the first function unit 500 may transmit an image captured by the first function unit to the second application unit.

The first application unit transfers the captured image to the base unit 200, when it transmits the received captured image to the second application unit.

The second function unit may be coupled to the outer side of the right side part 130 for displaying an image. Upon receiving the captured image, the second application unit may control the second function unit so that the received image is displayed on the second function unit.

Through interactions between the first function unit, the first application unit, the second function unit and the second application unit, the smart toy platform 100 according to at least one embodiment of the present invention shown in FIG. 7 has its one side surface capture a frontal image and has another side surface display the captured image.

Figure 8:
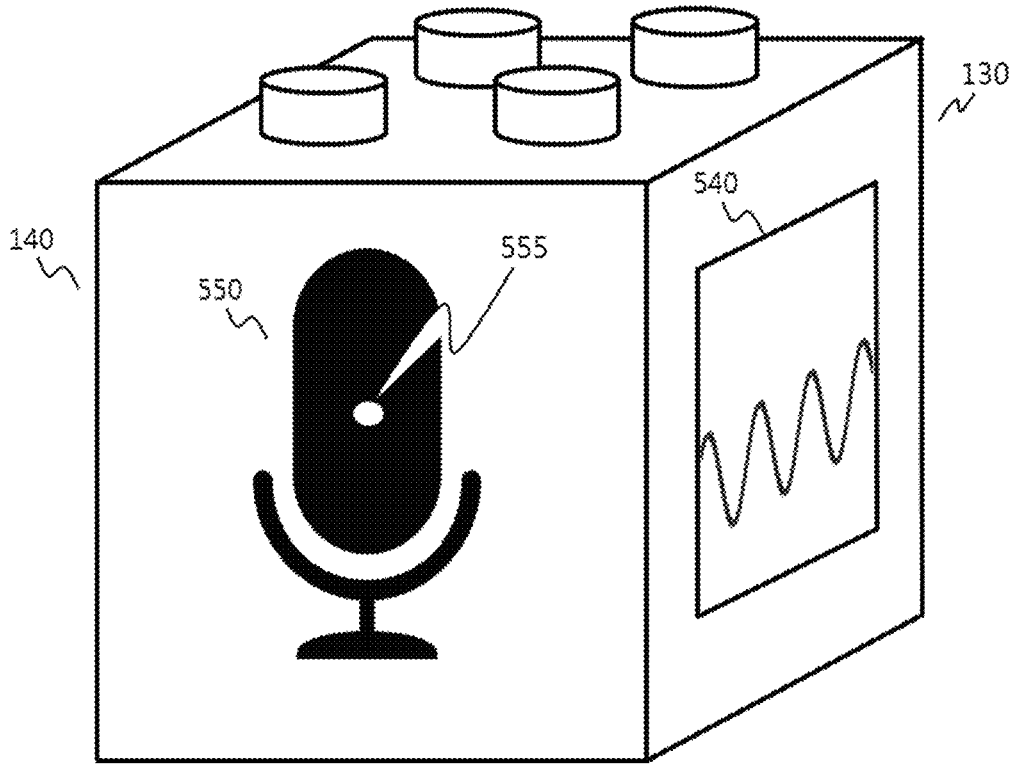

As shown in FIG. 8, the smart toy platform 100 according to at least one embodiment of the present invention includes a third function unit and a second function unit. The third function unit includes a recording module coupled to the inner side of the front part 140. The second function unit includes the image display module 540 coupled to the outer side of the right side part 130. The smart toy platform 100 further includes a third application unit for controlling the third function unit, and a second application unit for controlling the second function unit. The third application unit and the second application unit may be the same or different application units.

The second function unit is the same as the second function unit described in FIG. 7, and therefore further description thereof is omitted for the sake of redundancy.

The third function unit includes a recording module capable of recording voice or ambient sound. The third function unit may be coupled to the inner side of the front part 140. The outer side of the front part 140 is printed with a recorder icon 550 indicating that a recording module is coupled. To transmit a sound wave to the recording module, a sound wave channel 555 may be formed in the front part 140. The third function unit may record sound waves transmitted through the sound wave channel 555. The third application unit may transmit the recorded data to the second application unit.

The third application unit transmits the recorded data to the base unit 200 which, upon receiving the recorded data, may transmit the same to the second application unit.

As shown in FIG. 8, the second application unit may display an image showing the recorded data received via the base unit 200.

Through the interaction between the second function unit, the second application unit, the third function unit and the third application unit, the smart toy platform 100 according to at least one embodiment of the present invention illustrated in FIG. 8 may record the surrounding sound on one side and visually display the recorded data on the other side.

Figure 9:
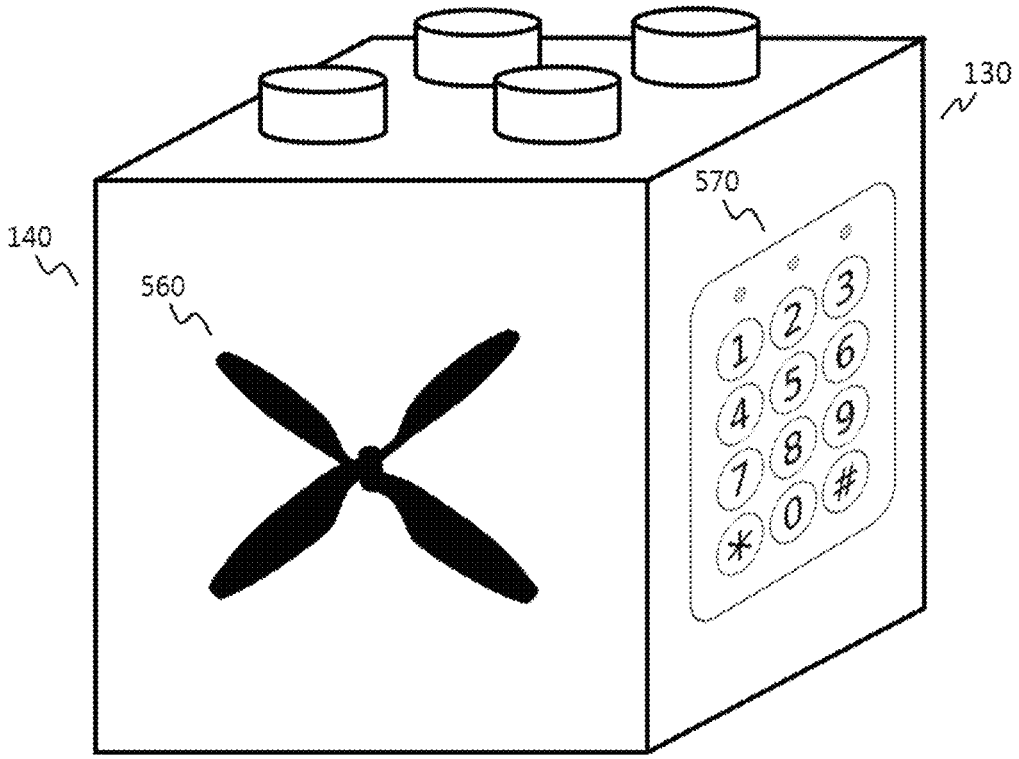

As shown in FIG. 9, the smart toy platform 100 according to at least one embodiment of the present invention includes a fourth function unit and a fifth function unit. The fourth function unit includes a propeller module 560 coupled to the outer surface of the front part 140. The fifth function unit includes a keypad module 570 coupled to the outer side of the right side part 130. The smart toy platform 100 may further include a fourth application unit that controls the fourth function unit, and a fifth application unit that controls the fifth function unit. The fourth application unit and the fifth application unit may be the same or different application units.

The fifth application unit may identify the value of the input key indicated by the input signal based on the signal input to keypad module 570. The fifth application unit may transmit the value of the identified key to the fourth application unit.

The fifth application unit transfers the value of the identified key to the base unit 200. The base unit 200 receives the value of the identified key and transmits the received key value to the fourth application unit.

Upon receiving the key value, the fourth application unit may control the propeller module 560 to rotate at a rotational speed corresponding to the key value received.

Through interactions between the fourth function unit, the fourth application unit, the fifth function unit and the fifth application unit, as illustrated in FIG. 9, the smart toy platform 100 according to at least one embodiment of the present invention receives an input of the rotational speed of the propeller module 560 and allows the propeller module 560 to rotate according to the input rotational speed.

Figure 10:
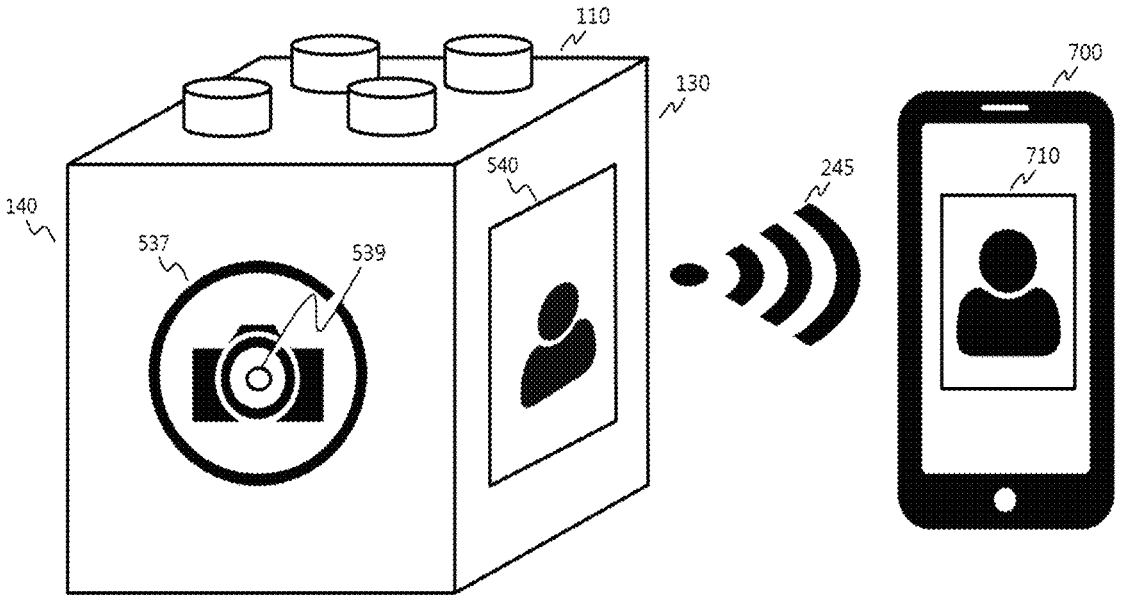

FIG. 10 shows a system for interlocking the smart toy platform 100 and external equipment according to at least one embodiment of the present invention.

As shown in FIG. 10, the smart toy platform 100 and a smart device 700 shown in FIG. 7 may constitute an interactive interlocking system.

The communication unit 230 included in the base unit 200 of the smart toy platform 100 establishes a data connection with the outside smart device 700 and can transmit and receive data. The data connection includes a wired or wireless connection.

As shown in FIG. 10, the communication unit 230 of the smart toy platform 100 may transmit the image captured by the first function unit to the smart device 700. Upon receiving the captured image, the smart device 700 may display the received image on the display means at a display area 710.

The smart toy platform 100 may also be controlled by using the smart device 700 via such interworking system. For example, the smart device 700 may be used to enable or disable the operation of the camera module of smart toy platform 100.

The smart device 700 may be a PC, a notebook computer, a tablet or a smartphone, but is not limited thereto.

Shown in FIG. 10 is one example of utilizing the smart toy platform 100 according to at least one embodiment of the present invention, and an external device establishing a data communication with the smart toy platform 100 is not limited to the smart device 700.

Figure 11:
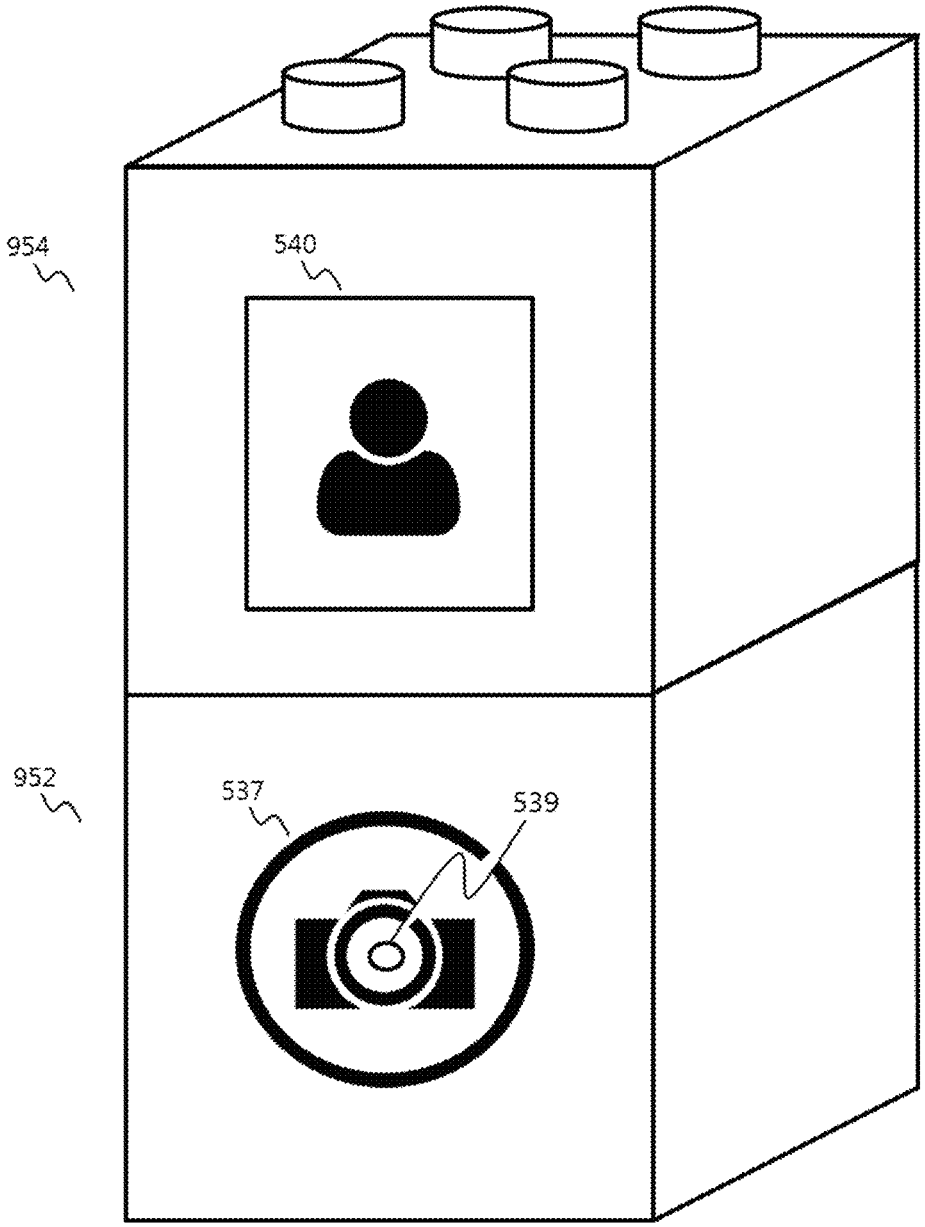

FIG. 11 illustrates a coupling system wherein multiple smart toys 100 according to at least one embodiment of the present invention operate in conjunction.

In accordance with at least one embodiment of the present invention, the multiple smart toy platforms 100 have coupling protrusions formed at the top of the top part 110 and coupling grooves formed at the bottom of the bottom part 160. The coupling protrusion and the coupling groove may be coupled to each other.

As shown in FIG. 11, a first smart toy platform 952 and a second smart toy platform 954 can be coupled together. Although visually obstructed in FIG. 11, the first smart toy platform 952 and the second smart toy platform 954 are vertically stacked by joining the coupling protrusion of the first smart toy platform 952 to the coupling groove of the second smart toy platform 954.

One side part of the first smart toy platform 952 is coupled with a first function unit including a camera module 539, and one side part of the second smart toy platform 954 is coupled with a second function unit including the image display module 540.

The image captured by the first function unit may be transmitted to the second base unit of the second smart toy platform 954 by the first base unit of the first smart toy platform 952. The second base unit may pass the transmitted image to the second function unit. The second function unit may cause the transmitted image to be displayed on the image display module 540 coupled to one side of a second smart toy platform 954.

FIG. 11 shows an example that data communications can be performed between multiple smart toy platforms and that data can be shared through the data communications. Therefore, data communications are not limited to those illustrated in FIG. 11.

Although detailed description have been provide for examples of utilizing the smart toy platform according to at least one embodiment of the present invention illustrated in FIGS. 7 to 11, possible applications are not limited to those as shown above.

Although discussed in the detailed description of FIGS. 7 to 11, the smart toy platform according to at least one embodiment of the present invention may become a smart toy with a new feature by replacing the first part incorporating a function with the second part incorporating another function. In addition, it may have both the first part and the second part attached to become a smart toy having the function provided by the first part and the function provided by the second part, respectively. Alternatively, both the first part and the second part may be attached to become a smart toy that provides a combination of the function provided by the first part and the function provided by the second part.

Figure 12:
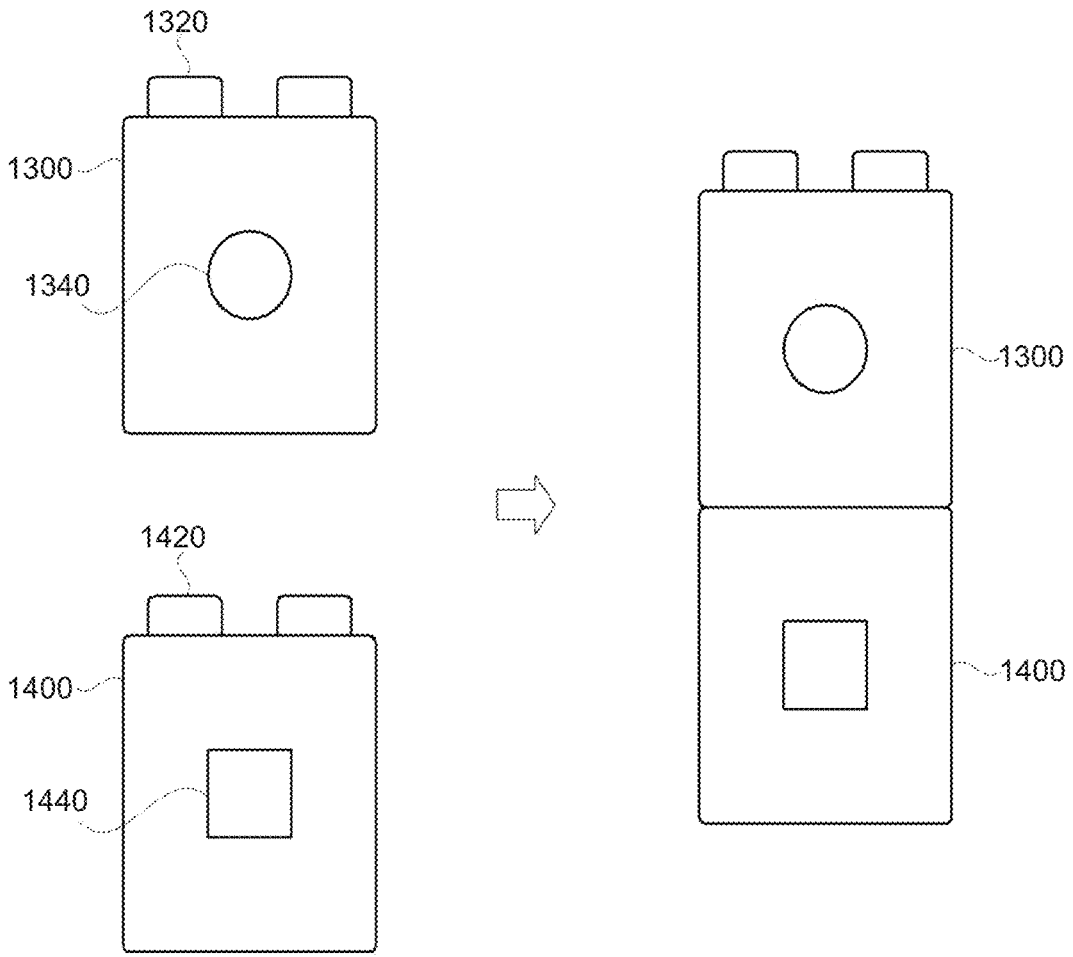
FIG. 12 is a schematic diagram of an assembly unit set according to some embodiments of the present invention.
Figure 13:
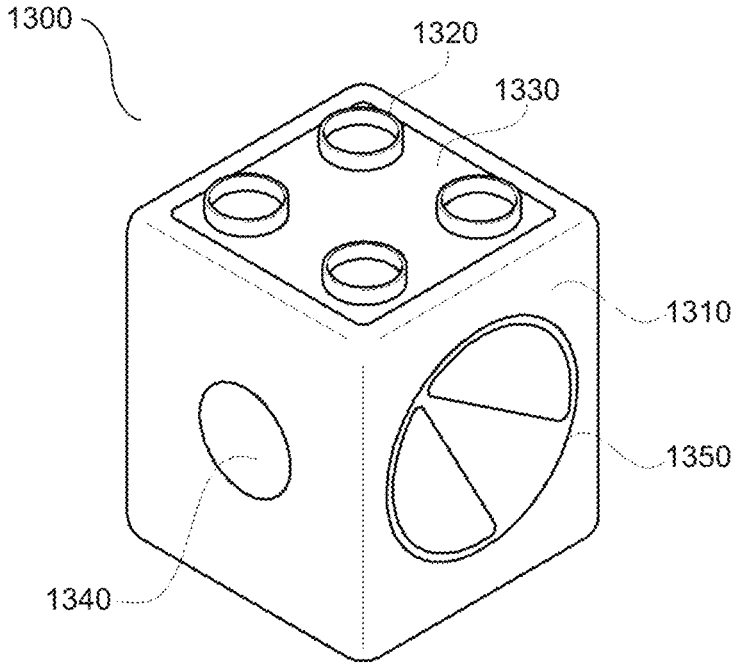
FIG. 13 is a schematic diagram of a trigger block according to some embodiments of the present invention.
Figure 14:
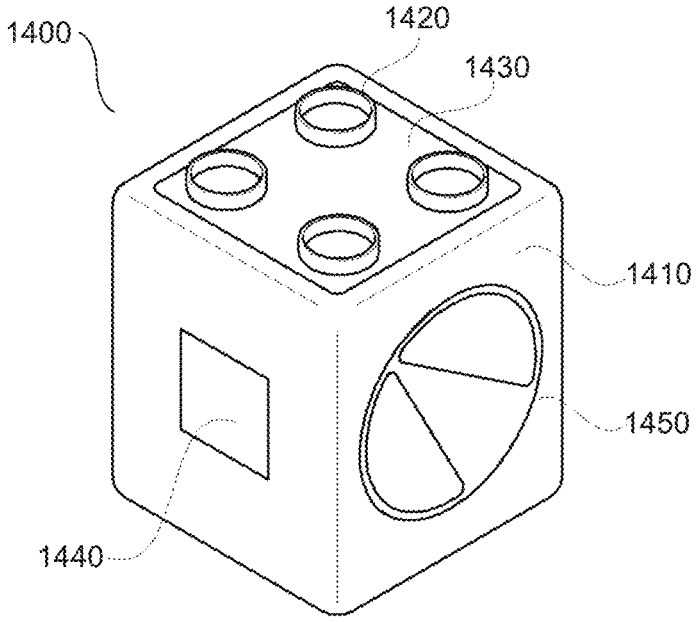
FIG. 14 is a schematic diagram of a driving block according to some embodiments of the present invention.

FIG. 12 is a schematic diagram of an assembly unit set according to some embodiments of the present invention; FIG. 13 is a schematic diagram of a trigger block 1300 according to some embodiments of the present invention; and FIG. 14 is a schematic diagram of a driving block 1400 according to some embodiments of the present invention.

An assembly unit set according to at least one embodiment of the present invention may be configured to include a trigger block 1300 and a driving block 1400.

The trigger block 1300 has at least one side provided with a coupling element and shifts to a standby mode at the time of coupling by a coupling element. The trigger block 1300 may output a trigger signal when detecting a specific signal in the standby mode. The trigger block 1300 may be in the form of a polyhedron or have a three-dimensional geometric structure. The trigger block 1300 may be provided with an internal space for accommodating parts. The trigger block 1300 has a body of, for example, plastic material.

The trigger block 1300 may include mechanical coupling elements or magnetic coupling elements that may be coupled with other trigger blocks, driving blocks, control blocks, base blocks or common toy blocks.

The coupling element 1320 may be configured to include at least one of, for example, a mechanical coupling element and a magnetic coupling element.

The mechanical coupling element has, for example, one or a plurality of coupling studs is formed on at least one surface of the body. The coupling stud may include a portion protruding outward from the center of the body and a through hole portion. The trigger blocks 1300 may be coupled to each other by fitting one block by the protruding portion of the coupling stud to the other block at the through hole portion.

The magnetic coupling element can be configured to include, for example, at least one or more neodymium magnets. Hereinafter, in some embodiments of the present invention, the coupling element and the coupling stud may be interchangeably used to mean the same thing. The number of coupling elements or coupling studs may be varied and may be in a singular form or formed asymmetrically.

The coupling element 1320 of the trigger block 1300 may have a coupling sensing element 1330 arranged for detecting whether or not a coupling is made and outputting a signal for shifting to the standby mode. The coupling sensing element 1330 may be composed of, for example, a switching element. The coupling sensing element 1330 may be formed, for example, on the same plane as the coupling element 1320 and can detect whether a coupling is made via a physical or electrical switching action at the time of coupling with another block.

The coupling sensing element 1330 may have, for example, a pressure-type switching element disposed on the surface where the coupling stud 1320 is formed, so as to detect whether a coupling is made based on a physical force applied from another block coupled to the coupling stud 1320.

The coupling sensing element 1330 have, for example, a pressure-type switching element disposed around the through hole, so as to detect whether a coupling is made based on a physical force applied from another block coupled to the through hole.

The coupling sensing element 1330 outputs a standby mode signal when a coupling is detected, and the trigger block 1300 shifts to a standby mode.

On one side of the trigger block 1300, a detection sensor 1340 may be provided. In some embodiments, the sensor 1340 includes one of a switching element, an ultrasonic sensor, a light sensor, a color sensor, an audio sensor, an acceleration sensor, an infrared sensor, an impact sensor, a touch sensor, a temperature sensor, a humidity sensor, an infrared remote control sensor.

The trigger block 1300 operates in the standby mode to detect an external signal, and it outputs a trigger signal when the sensed signal exceeds a threshold value. The above listed elements or sensors detect an external signal.

The trigger block 1300 operates in the standby mode to detect an external signal and outputs a trigger signal when the sensed signal exceeds the threshold value. The above listed elements or sensors detect an external signal.

The ultrasonic sensor may be disposed, for example, on one side of the trigger block 1300, to measure speed, distance, concentration, viscosity, etc. by receiving return ultrasonic waves after being transmitted to the outside. The ultrasonic sensor may output the trigger signal to the outside when the intensity of the received ultrasonic signal exceeds a threshold value.

The light sensor may be disposed on one side of the trigger block 1300, for example, to detect the intensity of the light. When the light intensity exceeds a threshold value, the light sensor may output the trigger signal to the outside.

The color sensor may be disposed on one side of the trigger block 1300, for example, to detect the spectral intensity of the light energy. When the detected spectral intensity exceeds a threshold value, the color sensor may output the trigger signal to the outside.

The sound sensor may be disposed inside the trigger block 1300, for example, to output a trigger signal to the outside when the intensity of the sound signal detected from the outside exceeds a threshold value.

The acceleration sensor may be disposed inside the trigger block 1300, for example, to detect a force applied to the trigger block 1300, gradient, and the like. When the numerical values exceed threshold values, the acceleration sensor may output the trigger signal to the outside.

The infrared sensor may be disposed on one side of the trigger block 1300, for example, to detect the amount of infrared rays, to output the trigger signal to the outside when the amount of the infrared light detected exceeds a threshold value.

The temperature sensor may be disposed, for example, on one side of the trigger block 1300, to detect the external temperature, and output the trigger signal to the outside when the detected temperature value exceeds a threshold value.

The humidity sensor may be disposed on one side of the trigger block 1300, for example, to detect external humidity, and output a trigger signal to the outside when the detected humidity value exceeds a threshold value.

The infrared remote control sensor may be disposed on one side of the trigger block 1300, for example, to detect an infrared signal, and output the trigger signal to the outside when the intensity of the infrared signal received from the infrared light emitting module exceeds a threshold value.

The trigger block 1300 may output a trigger signal by a broadcast method. The trigger block 1300 is installed with modules such as an NFC (Near Field Communication) module, an RFID (Radio Frequency Identification) module, an infrared communication module, a Bluetooth module, or a ZigBee module, for example. The trigger block 1300 may output a trigger signal by a broadcast method when a detected signal exceeds a threshold value.

The trigger block 1300 may output a non-trigger signal to the outside when a signal exceeding the threshold value is not detected beyond the standby time after outputting the trigger signal. The trigger block 1300 may output a non-trigger signal to the outside by a broadcast system. Here, the threshold value and the standby time may be adjusted by the first control block.

The trigger signal may be composed of a 1-bit signal as a control signal for causing the driving block 1400 in the standby mode within a predetermined space to start operation. According to at least one embodiment of the present invention, the driving block 1400 is controlled to perform its operation with only a 1 bit trigger signal. For example, when the trigger block 1300 detects an external stimulus exceeding a threshold, it broadcasts a 1-bit trigger signal. The driving block 1400 that the received trigger signal performs the specified operation. That is, the trigger signal of the trigger block 1300 refers to an 'on' signal, and the trigger signal of the trigger block 1300 can collectively control various driving blocks 1400 in an intuitive manner by outputting such a simple on/off form of signal.

In addition, the trigger block 1300 can control the driving block 1400 with an off signal (non-trigger signal) along with the 'on' signal by using a 1-bit trigger signal.

In another embodiment of the present invention, the driving blocks 1400 may be controlled for each group by using a plurality of channel-specific trigger signals (ON/OFF). In this case, the plurality of driving blocks 1400 may be implemented in such a manner that they have mutual communication channels fixed so that the driving blocks 1400 operate in response only to the trigger signal of a specific trigger block 1300.

The trigger block 1300 may be provided on one side thereof with a converting element 1350 for adjusting the threshold values of the trigger block 1300. The converting element 1350 may be, for example, an analog dial element or a digital switch element which may be manipulated to adjust the threshold of the trigger block 1300. The threshold value of the trigger block 1300 may refer to a sensor sensitivity of a trigger such as a switching element, an ultrasonic sensor, a light sensor, a color sensor, an audio sensor, an acceleration sensor, an infrared sensor, an impact sensor, a touch sensor, a temperature sensor, a humidity sensor, and an infrared remote control sensor.

Unlike in FIG. 13, the converting element 1350 may be provided on the same surface as the sensor 1340 or on the opposite side of the sensor 1340.

Unlike some embodiments of the present invention, the converting element may not be provided in the trigger block 1300 but in a separate block. A detailed explanation therefor will be made through FIGS. 15 and 16.

The driving block 1400 has a coupling element on at least one surface and shifts to a standby mode at the time of coupling by a coupling element.

The driving block 1400 can operate when it receives a trigger signal in the standby mode.

The driving block 1400 may be in the form of a polyhedron or have a three-dimensional geometric structure. The driving block 1400 may have an internal space formed for accommodating parts, and it may have a body 1410 of, for example, plastic material.

The driving block 1400 may include mechanical coupling elements or magnetic coupling elements that can be coupled with other drive blocks, trigger blocks, control blocks, base blocks, or common toy blocks.

The coupling element may be configured to include, for example, at least one of a mechanical coupling element and a magnetic coupling element.

The mechanical coupling element may be implemented, for example, by forming one or a plurality of coupling studs 1420 on at least one side of the body 1410. The coupling stud 1420 may include a portion protruding outward from the center of the body and a through hole portion. Multiples of the driving block 1400 can be coupled to each other by fitting the protruding portion of the coupling stud 1420 to the through hole portion of another block.

The magnetic coupling element may be configured to include, for example, at least one or more neodymium magnets. Hereinafter, in some embodiments of the present invention, the coupling element and the coupling stud may be interchangeably used to convey the same meaning. The number of coupling elements or coupling studs may vary and may be in a singular form or formed asymmetrically.

The coupling element 1420 of the driving block 1400 may be provided with a coupling sensing element 1430 for detecting whether coupling is made and outputting a signal for shifting to the standby mode. The coupling sensing element 1430 may be composed of, for example, switching elements. The coupling sensing element 1430 can be formed, for example, on the same plane as the coupling element and can detect whether coupling is made, by way of physical or electrical switching action when coupling with other blocks.

The coupling sensing element 1430 may be implemented by a pressure-type switching element disposed on the surface where the coupling stud 1420 is formed, to detect whether coupling is made based on a physical force applied from another block coupled to the coupling stud 1420.

The coupling sensing element 1430 may be, for example, a pressure-type switching element arranged around the through hole, and it can detect whether coupling is made based a physical force applied from another block coupled to the through hole.

The coupling sensing element 1430 outputs a standby mode signal when coupling is detected, and the driving block 1400 shifts to the standby mode.

On one side of the driving block 1400, a driving element 1440 may be provided. The driving element 1440 may include, for example, any one of an actuator, a camera module, a display module, a speaker module, and a light emitting element.

The actuator may be disposed, for example, inside or on one side of the driving block 1400 and is driven upon receipt of the trigger signal. The actuator may refer to various drive devices such as a motor, piston, cylinder, shaft gear, and it performs operations such as rotational movement, axial movement, piston movement, etc. in response to a trigger signal. The actuator can be driven for a set time or it can be driven until the reception of a non-trigger signal. The driving time and the driving method of the actuator can be adjusted by the second control block.

The camera module may be disposed on, for example, one side of the driving block 1400, and when receiving the trigger signal, the camera module is driven to perform an image capturing operation. The camera module performs a continuous shooting operation or performs a singular shooting operation at the time of receiving the trigger signal. In the case of continuous shooting operation, the shooting operation is stopped upon receiving a non-trigger signal from the trigger block. The photographing time and the photographing method of the camera module can be adjusted by the second control block.

The display module may be disposed, for example, on one side of the driving block 1400, and upon receiving the trigger signal, it performs an image/video output operation. The display module may be driven for a set time or it can be driven until receiving a non-trigger signal. The image output time, output signal, and output method of the display module can be adjusted by the second control block.

The speaker module may be disposed, for example, on one side of the driving block 1400, and upon receiving a trigger signal, it performs an audio output operation. The speaker module may be driven for a set time or it can be driven until receiving a non-trigger signal. The audio output time, output signal, and output method of the speaker module may be adjusted by the second control block.

The light emitting element may be disposed, for example, inside the driving block 1400, and upon receiving the trigger signal, it performs a light emitting operation. The light emitting element may be driven for a set time or it can be driven until a non-trigger signal is received. The light emission time and the light emission mode of the light emitting element can be adjusted by the second control block.

On one side of the driving block 1400, a converting element 1450 may be provided to adjust at least one of the type and the time of the operation performed by the driving block 1400. The converting element 1450 may be, for example, an analog dial element or a digital switch element, and at least one of the operation type and the operation time of the drive block 200 is adjusted according to the operation of the dial element or the digital switch element.

Unlike in FIG. 14, the converting element 1450 may be provided on the same surface as the driving element 1440 or on the opposite surface of the driving element 1440.

Unlike some embodiments of the present invention, a converting element may be provided not in the driving block 1400 but in another block. A detailed explanation thereof this will be provided through FIG. 6.

Figure 15:
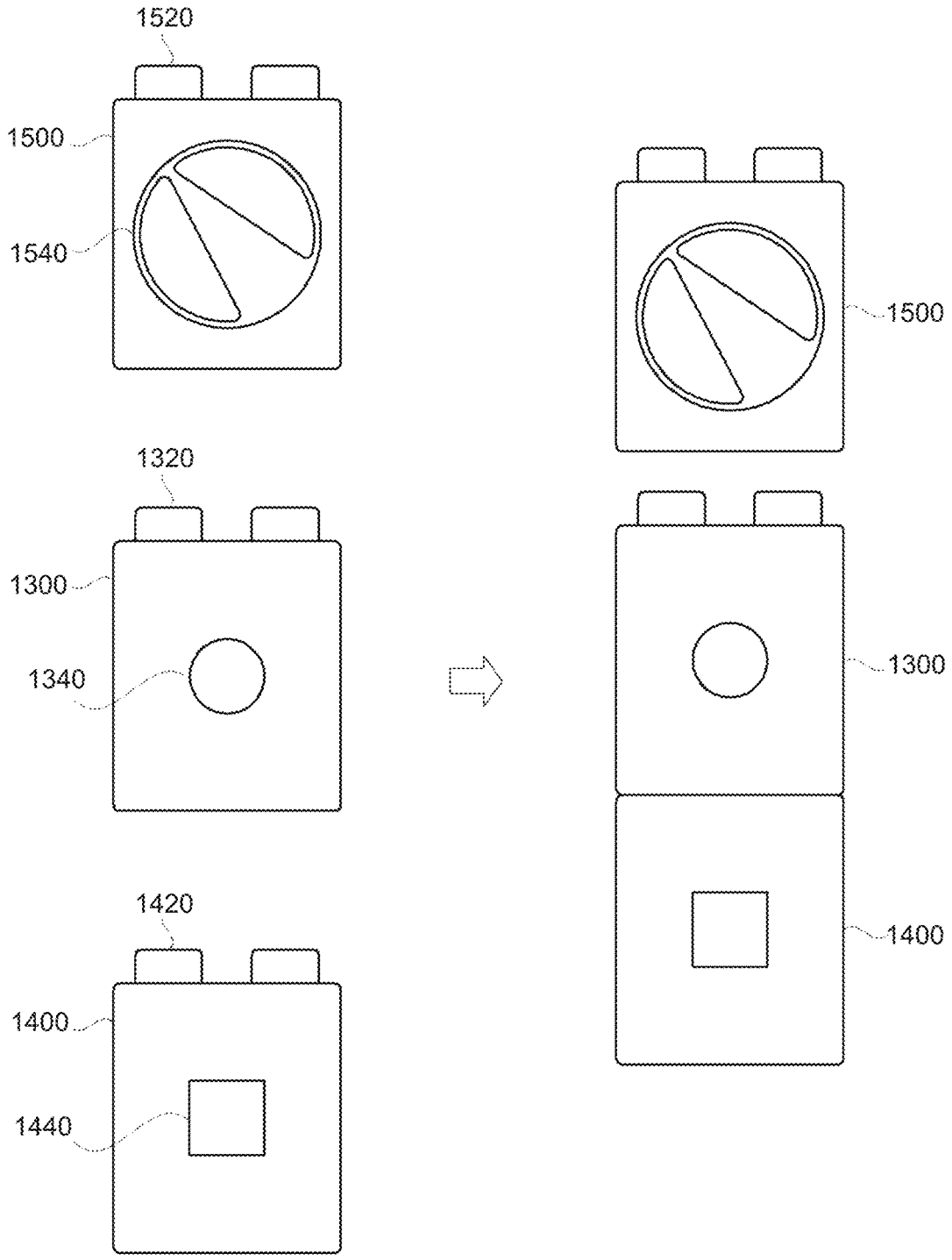
FIG. 15 is a schematic diagram of an assembly unit set according to some embodiments of the present invention.
Figure 16:
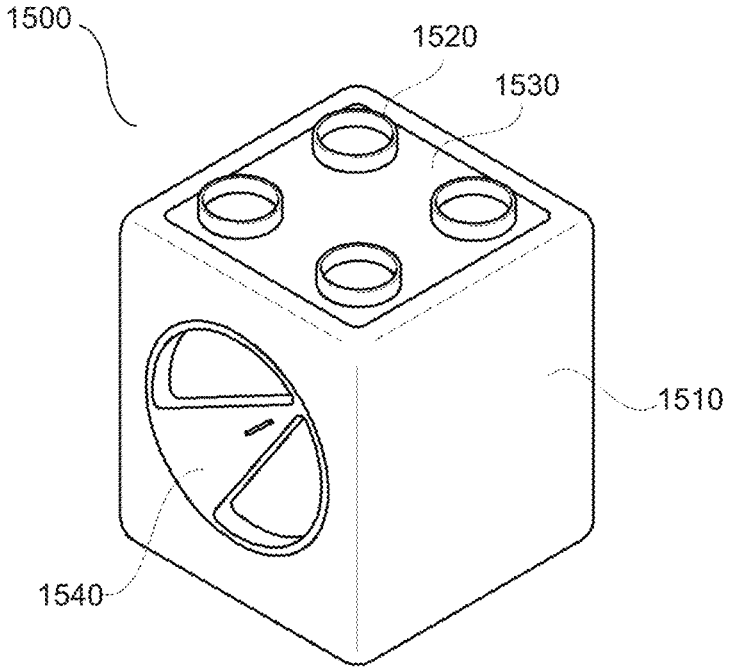
FIG. 16 is a schematic diagram of a control block according to some embodiments of the present invention.

FIG. 15 is a schematic diagram of a set of assembly units according to some embodiments of the present invention, and FIG. 16 is a schematic diagram of a control block according to some embodiments of the present invention.

As shown in FIGS. 15 and 16, the assembly unit set according to another embodiment of the present invention may include a trigger block 1300, a driving block 1400, and a first control block 1500.

Repeat explanations on FIGS. 1 to 3 for the trigger block and the drive block will be omitted.

The first control block 1500 has at least one side provided with a coupling element 1520, shifts to a standby mode upon coupling by the coupling element 1520, and outputs a signal for adjusting the threshold value of the trigger block 1300 according to the external input.

The first control block 1500 can be in the form of a polyhedron or have a three-dimensional geometric structure. The first control block 1500 may have an internal space formed for accommodating parts, and it may have a housing of, for example, plastic material.

The first control block 1500 may include a mechanical coupling element or a magnetic coupling element that can be combined with a trigger block, a drive block, a control block, a base block, or a common toy block.

The coupling element 1520 may be configured to include at least one of, for example, a mechanical coupling element and a magnetic coupling element.

The mechanical coupling element may be implemented by one or a plurality of coupling studs 1520 formed, for example, by forming at least one side of the body 1510. The coupling stud 1520 may include a portion protruding outward from the center of the body and a through hole portion. Multiples of the first control block 1500 can be coupled to each other by fitting the outwardly protruding portion of the coupling stud 1520 to the through hole portion of another block.

The magnetic coupling element may be configured to include, for example, at least one or more neodymium magnets. Hereinafter, in some embodiments of the present invention, the coupling element and the coupling stud may be interchangeably used to convey the same meaning. The number of coupling elements or coupling studs may be varied and may be in a singular form or formed asymmetrically.

The coupling element 1520 of the first control block 1500 may have a coupling sensing element 1530 arranged for detecting whether coupling is made and outputting a signal for shifting to the standby mode. The coupling sensing element 1530 may be composed of, for example, switching elements. The coupling sensing element 1530 may be formed, for example, on the same plane as the coupling element 1520, and it can detect whether coupling is made, by way of a physical or electrical switching action when coupling with another block.

The coupling sensing element 1530 may be implemented by the pressure-type switching element disposed on the surface where the coupling stud 1520 is formed, and it can detect whether coupling is made based on a physical force applied from another block coupled to the coupling stud 1520.

The coupling sensing element 1530 may be, for example, a pressure-type switching element arranged around the through hole, and it can detect whether coupling is made based on a physical force applied from another block coupled to the through hole.

On one side of the first control block 1500, a converting element 1540 may be provided for adjusting the threshold of the trigger block 1300.

The converting element 1540 can be, for example, an analog dial element or a digital switch element, and the threshold of the trigger block 1300 can be adjusted according to the operation of the dial element or the digital switch element.

In addition, on one side of the first control block 1500, a converting element (not shown) may be provided capable of setting a standby time for outputting a non-trigger signal with the trigger block 1300. The converting element may be, for example, an analog dial element or a switch element, and the standby time of the trigger block can be adjusted according to the operation of the dial element or the digital switch element.

Figure 17:
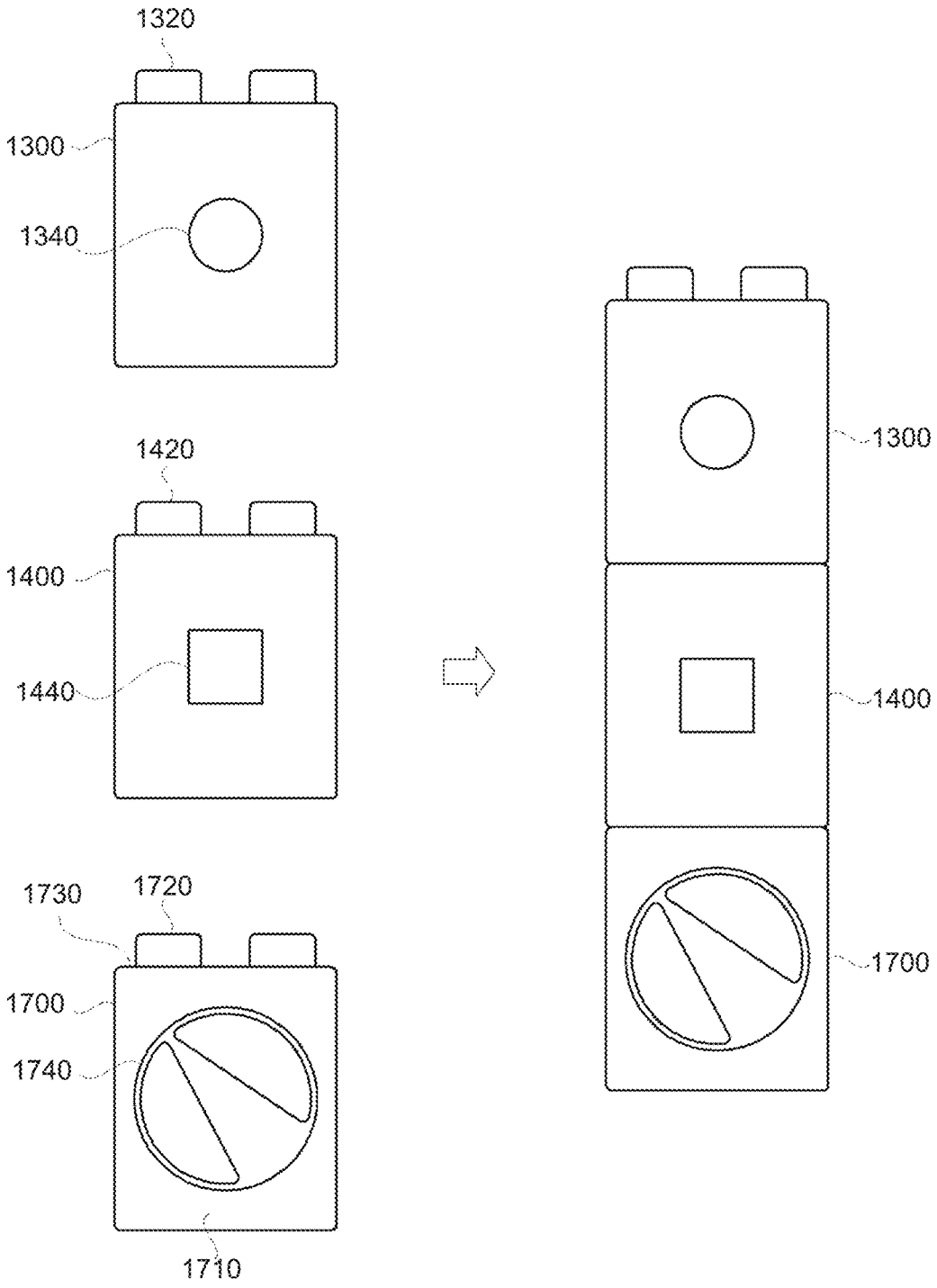
FIG. 17 is a schematic diagram of an assembly unit set according to some embodiments of the present invention.

FIG. 17 is a schematic diagram of an assembly unit set according to some embodiments of the present invention.

As shown in FIG. 17, an assembly unit set according to another embodiment of the present invention may include a trigger block 1300, a driving block 1400, and a second control block 1700.

Repeat explanations on FIGS. 1 to 3 for the trigger block and the drive block will be omitted.

The second control block 1700 has a coupling element 1720 on at least one side, and shifts to a standby mode upon coupling by a coupling element 1720, and outputs a signal for changing the type of operation performed by the driving block 1700 according to an external input.

The second control block 1700 may be in the form of a polyhedron or have a three-dimensional geometric structure. The second control block 1700 may have an internal space formed for accommodating parts, and it may have a body 1710 of, for example, plastic material.

The second control block 1700 may include a mechanical coupling element or a magnetic coupling element that may be coupled to a trigger block, a drive block, a control block, a base block, or a common toy block.

The coupling element 1720 may be configured to include, for example, at least one of a mechanical coupling element and a magnetic coupling element.

The mechanical coupling element may be formed, for example, by forming one or a plurality of coupling studs 1720 on at least one side of the body 1710. The coupling stud 1720 may include a portion protruding outward from the center of the body and a through hole portion. Multiples of the second control block 1700 may be coupled to each other by fitting the outwardly protruding portion of the coupling stud 1720 to the through hole portion of another block.

The magnetic coupling element may be configured to include, for example, at least one or more neodymium magnets. Hereinafter, in some embodiments of the present invention, the coupling element and the coupling stud may be interchangeably used to convey the same meaning. The number of coupling elements or coupling studs may vary and may be in a singular form or formed asymmetrically.

The coupling element 1720 of second control block 1700 may have a coupling sensing element 1730 arranged for detecting whether coupling is made and outputting a signal for shifting to the standby mode. The coupling sensing element 1730 may be composed of switching elements, for example. The coupling sensing element 1730 may be formed, for example, on the same plane as the coupling element 1720, and it can detect whether coupling is made, by way of a physical or electrical switching action when coupling with another block.

The coupling sensing element 1730 may be implemented by, for example, a pressure-type switching element disposed on the surface where the coupling stud 1720 is formed, to detect whether coupling is made based on a physical force applied from another block coupled to the coupling stud 1720.

The coupling sensing element 1730 may be, for example, a pressure-type switching element arranged around the through hole, and a detection on whether coupling is made may be performed based on a physical force applied from another block coupled to the through hole.

On one side of the second control block 1700, a converting element 1740 may be provided for changing at least one of the type and time of the operation performed by the driving block 1400. The converting element 1740 can be, for example, an analog dial element or a digital switch element, and the output signal and operation of the drive block can be controlled based on the conversion of the dial element or the digital switch element.

Further, on one side of the second control block 1700, a converting element (not shown) may be provided for allowing to set the operation time of the driving block 1400 can be prepared. The converting element may be, for example, an analog dial element or a digital switch element, and the operation time of the drive block may be adjusted based on switching operation of the dial element or the digital switch element.

Figure 18:
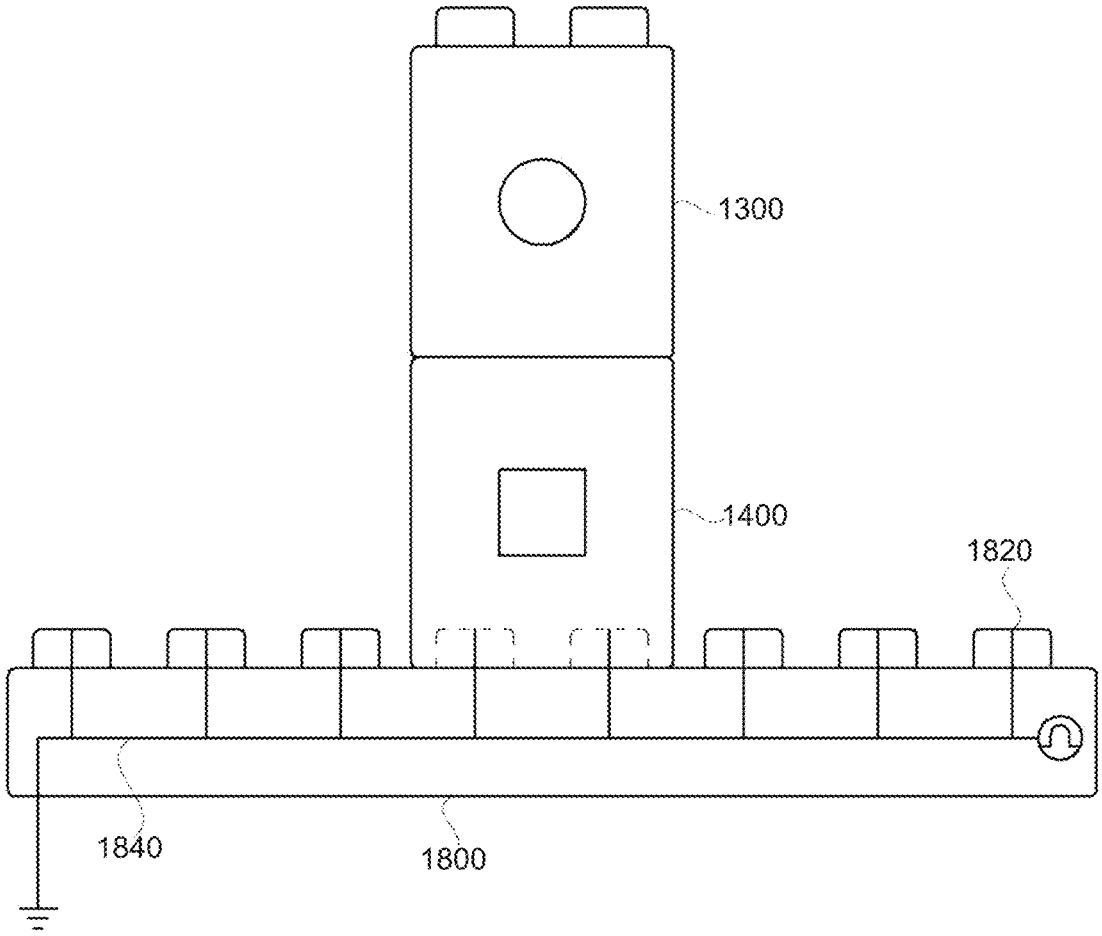
FIG. 18 is a schematic diagram of an assembly unit set according to some embodiments of the present invention.

FIG. 18 is a schematic diagram of an assembly unit set according to another embodiment of the present invention.

As shown in FIG. 18, an assembly unit set according to another embodiment of the present invention may include a trigger block 1300, a driving block 1400, and a base block 1800.

Repeat explanations of FIGS. 1 to 3 for the trigger block and the drive block will be omitted.

The base block 1800 is in the shape of a plate having a top surface formed with coupling studs 1820 protruding outwardly. The size and shape of the base block 1800 may vary depending on manufacturing options. It is also envisioned to use a method of assembling the base block with a single coupling stud.

The coupling stud 1820 of the base block 1800 can be arranged in a lattice pattern. In the coupling stud 1820, for example, positive and negative electrodes are alternately arranged to form a power line 1840, through which power can be supplied to the trigger block 1300 and the driving block 1400 which are coupled.

Figure 19:
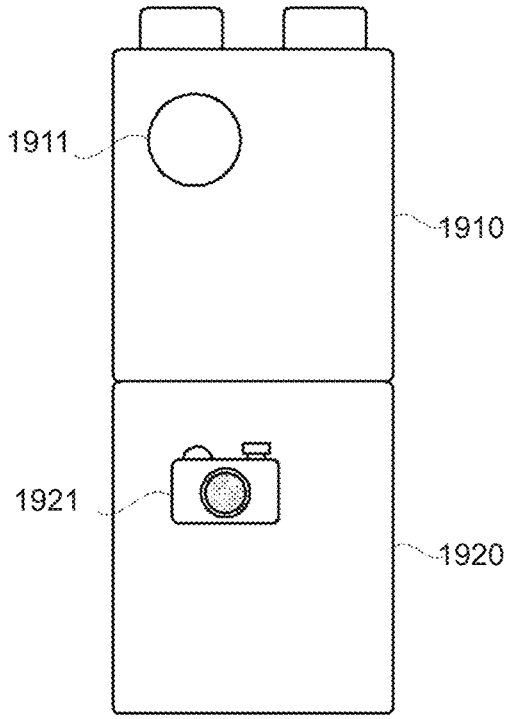
FIGS. 19 to 25 are schematic diagrams for illustrating operations of an assembly unit set according to some embodiments of the present invention.

FIG. 19 is a diagram for illustrating the operation of the assembly unit set according to some embodiments of the present invention.

As shown in FIG. 19, coupling has been made between a trigger block 1910 with a switching element 1911 and a driving block 1920 with a camera module 1921. The trigger block 1910 and the driving block 1920 have been shifted to the standby mode in the process of coupling. When the switching element 1911 is depressed, the trigger block 1910 outputs a trigger signal to the outside. Upon receiving the trigger signal, the camera module 1921 performs an image capturing operation.

Figure 20:
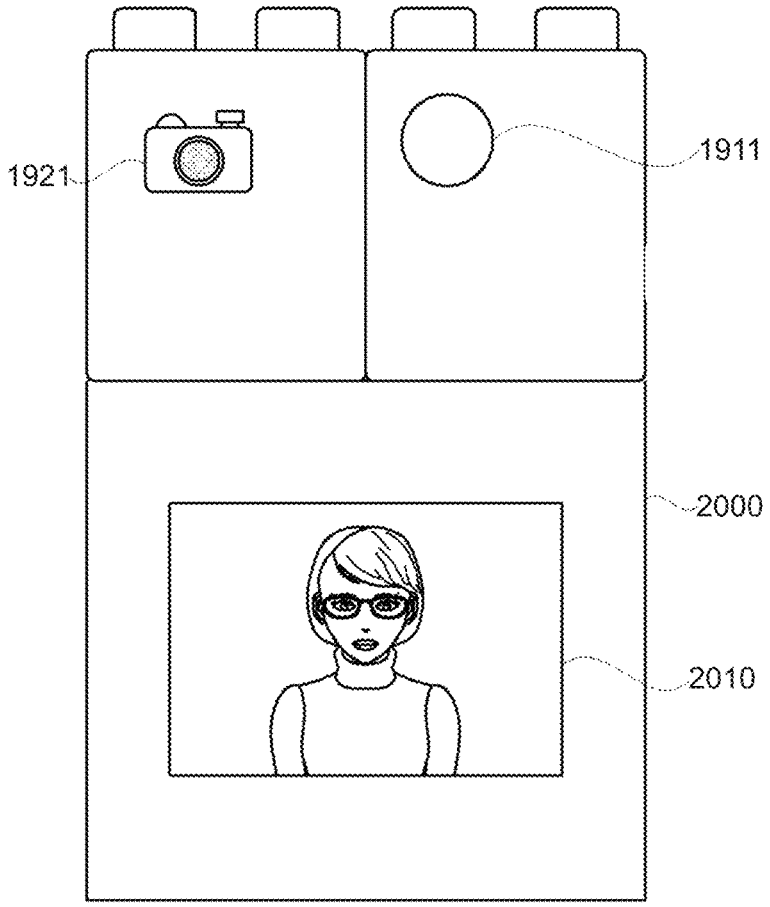

FIG. 20 is a diagram for illustrating the operation of the assembly unit set according to another embodiment of the present invention.

As shown in FIG. 20, coupling has been made between a trigger block 1910 with a switching element 1911, a first driving block 1920 with a camera module 1921 and a second driving module 2000 with a display module 2010. The trigger block 1910, the first driving block 1920, and the second driving module 2000 have been switched to a standby mode in the process of coupling. Here, when the switching element 1911 is depressed, the trigger block 1910 outputs a trigger signal to the outside. Upon receiving the trigger signal, the camera module 1921 performs the image capturing operation, and the display module 2010 performs the image output operation. At this time, the display module 2010 may display the image taken with the camera module 1921 to the outside.

Figure 21:
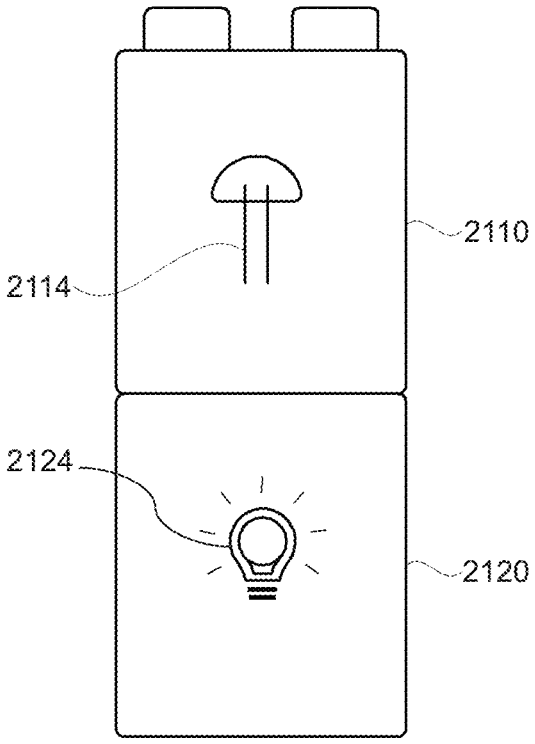

FIG. 21 is a diagram for illustrating the operation of the assembly unit set according to another embodiment of the present invention.

As shown in FIG. 21, coupling has been made between a trigger block 2110 with a light sensor 2114 and a driving block 2120 with a light emitting element 2124. The trigger block 2110 and the driving block 2120 have been switched to a standby mode in the process of coupling. Here, when the light sensor 2114 detects light exceeding the threshold value, it outputs a trigger signal to the outside. When the light emitting element 2124 receives the trigger signal, it performs the light emitting operation.

The sensitivity of sensing light by the light sensor 2114 may be adjusted via a converting element (not shown) provided on one side of the trigger block 2110. In addition, the operational category or time of the light emitting element 2124 including illumination intensity, the lighting method, and the lighting time may be adjusted via a converting element (not shown) provided on one surface of the driving block 2120.

Figure 22:
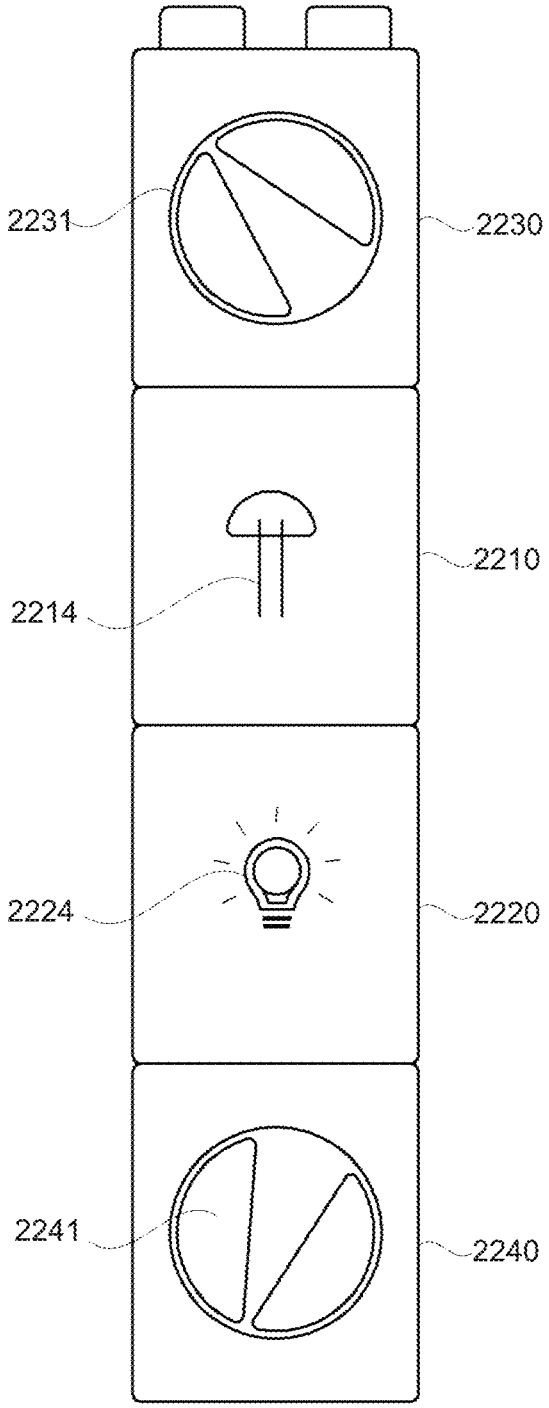

FIG. 22 is a diagram for illustrating the operation of the assembly unit set according to another embodiment of the present invention.

As shown in FIG. 22, coupling has been made between a trigger block 2210 with a light sensor 2214, a driving block 2220 with a light emitting element 2224, a first control block 2230 and a second control block 2240. The trigger block 2210, the driving block 2220, the first control block 2230, and the second control block 2240 have been switched to a standby mode in the process of coupling. Here, when the light sensor 2214 detects light exceeding the threshold value, it outputs a trigger signal. When the light emitting element 2224 receives the trigger signal, it performs a light emitting operation. At this time, the dial element 2231 of the first control block 2230 may be manipulated to adjust a threshold value or standby time of the trigger block 2210. The dial element 2241 of the second control block 2240 may be adjusted to change the light emitting time or the light emission method.

Figure 23:
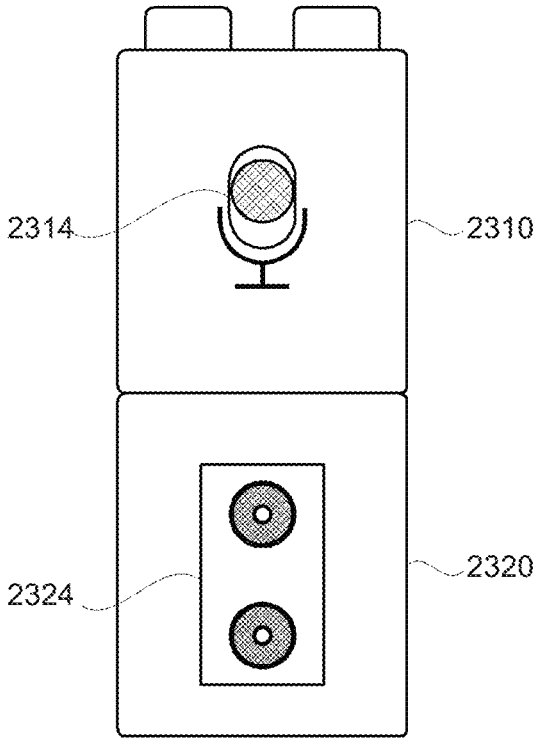

FIG. 23 is a diagram for illustrating the operation of the assembly unit set according to another embodiment of the present invention.

As shown in FIG. 23, coupling has been made between a trigger block 2310 with an audio sensor 2314 and a driving block 2320 with a speaker module 2324. The trigger block 2310 and the driving block 2320 have been switched to a standby mode in the process of coupling. Here, when the audio sensor 2314 receives an audio signal exceeding a threshold value, it outputs a trigger signal to the outside. Upon receiving the trigger signal, the speaker module 2324 performs an audio output operation. At this time, the speaker module 2324 may output the audio signal received by the audio sensor 2314 to the outside.

Figure 24:
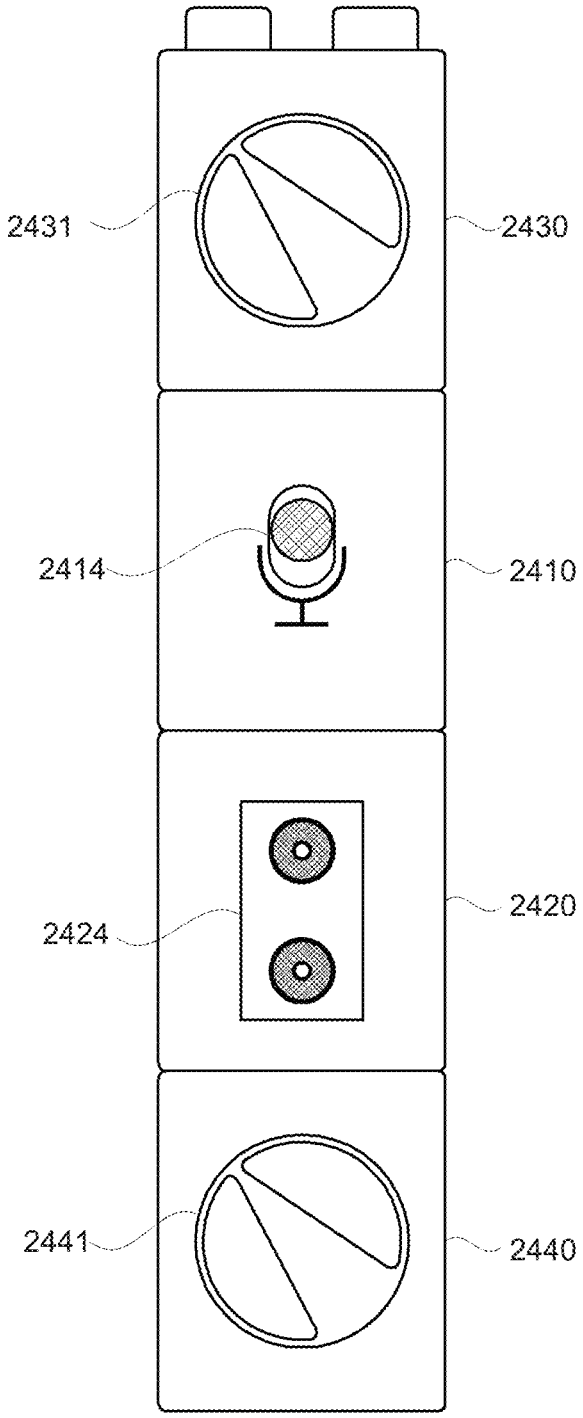

FIG. 24 is a diagram for illustrating the operation of the assembly unit set according to another embodiment of the present invention.

As shown in FIG. 24, coupling has been made between a trigger block 2410 with an audio sensor 2414, a driving block 2420 with a speaker module 2424, a first control block 2430, and a second control block 2440. The trigger block 2410, the driving block 2420, the first control block 2430, and the second control block 2440 have been switched to a standby mode in the process of coupling. Here, when the audio sensor 2414 receives an audio signal exceeding a threshold value, it outputs a trigger signal to the outside. When the speaker module 2424 receives the trigger signal, it performs an audio output operation. At this time, a dial element 2431 of the first control block 2430 may be manipulated to adjust the threshold value or the standby time of the trigger block 2410. A dial element 2441 of the second control block 2440 may be manipulated to change an audio output time, output signal or output method from the speaker module 2424.

Figure 25:
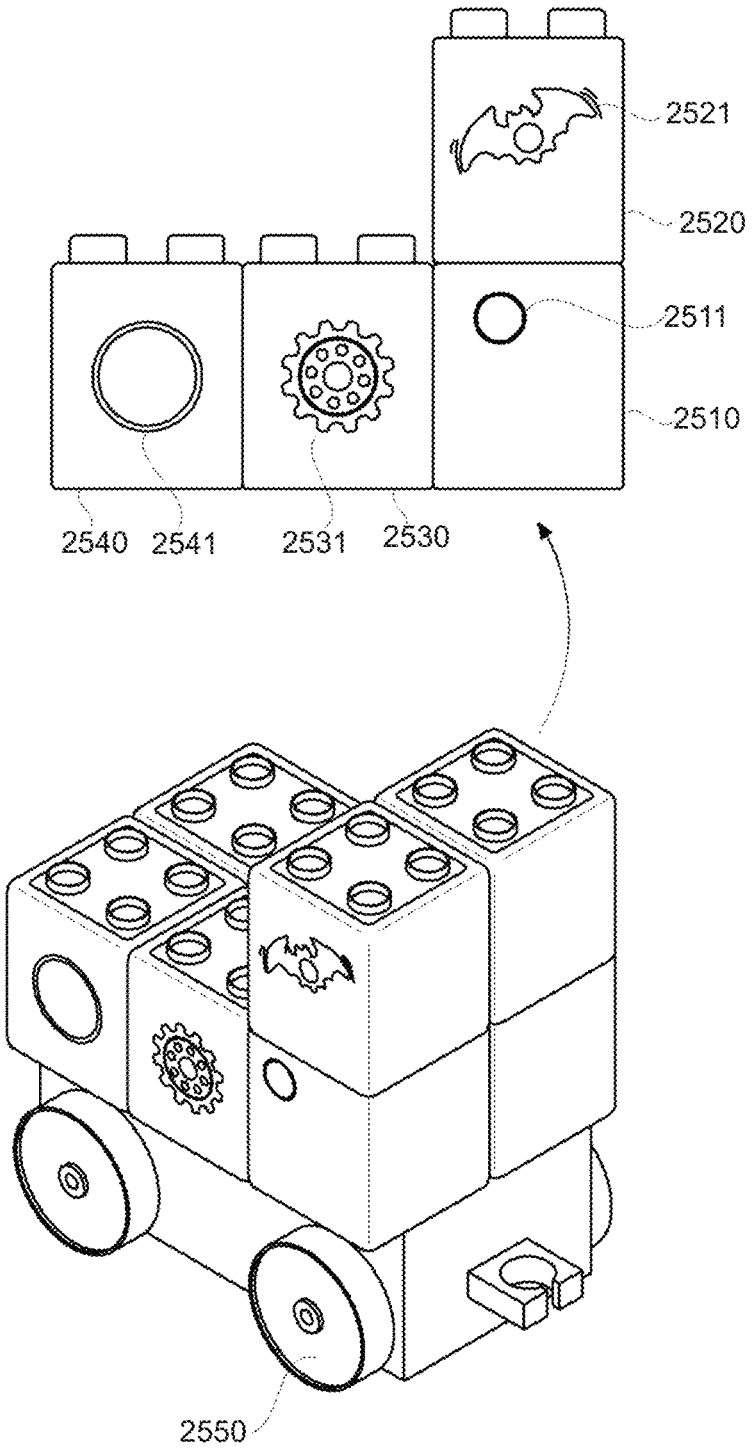

FIG. 25 is a diagram for illustrating the operation of the assembly unit set according to another embodiment of the present invention.

As shown in FIG. 25, coupling has been made between a first trigger block 2510 having an infrared remote sensor 2511, a second trigger block 2520 having an ultrasonic sensor 2521, a first driving block 2530 having a motor 2531, and a second driving block 2540 having a shaft drive gear 2541. The first trigger block 2510, second trigger block 2020, first driving block 2530, and second driving block 2540 have been switched to the standby mode in the process of coupling. Here, when the infrared remote sensor 2511 detects from an infrared light emitting module (not shown) an infrared signal exceeding the threshold value, it outputs a first trigger signal to the outside. In response to the first trigger signal, the motor 2531 of the first driving block 2530 operates to drive the wheel 2550 provided in the ordinary block. The second driving block 2540 shifts the shaft drive gear 2541 according to the first trigger signal to determine the moving direction of the wheel 2550.

The ultrasonic sensor 2511 frequently outputs the ultrasonic signal to the outside during movement, detects the intensity of the reflected ultrasonic signal, and thereby senses an external obstacle. The ultrasonic sensor 2511 outputs the second trigger signal when the intensity of the reflected ultrasonic signal is equal to or higher than the threshold value. The second driving block 2540 steers the wheel 2550 into different moving directions by shifting the shaft drive gear 2541 according to the second trigger signal. That is, the assembly unit set of the present invention can be combined with an ordinary block to control the movement via the external remote control light-emitting module. When the ultrasonic sensor 2511 senses a forward obstacle, it automatically steers away therefrom.

At this time, when the infrared signal is emitted by the remote control light-emitting module toward the first trigger block 2510, the first trigger block 2510 outputs the first trigger signal, the second driving block 2540 operates in response to the first trigger signal so as to change the movement of the wheel 2550.

The present invention resolves a technical problem to provide a smart toy platform capable of adding or deleting functions.

The present invention solves another technical problem to provide an assembly unit and a assembly unit set by providing a multifunctional block, multiples of which can be assembled so as to perform various functions such as image, audio, motion, and other services.

The technical problems covered by the present invention are not limited to those mentioned above, and other unmentioned technical problems could be clearly understood by those skilled in the art from the description below.

According to at least one embodiment of the present invention, a smart toy platform is provided capable of adding or deleting functions.

According to at least one embodiment of the present invention, a block capable of performing various functions is provided to carry out various operations such as image, audio, motion, and other services as combined.

Although some embodiments of the present invention have been described with reference to the accompanying drawings, those skilled in the art to which this invention pertains will appreciate that the invention can be implemented in other concrete forms without changing the technical idea and essential features thereof. It should therefore to be understood that the above-described embodiments are illustrative in all aspects and not restrictive. the inner side and the outer side, or an integrate manner.

What is claimed is:

1. A smart toy platform, comprising:

one top part, one bottom part, and a plurality of side parts, the top part, the bottom part, and the plurality of side parts being detachably assembled to define a body of a single block having a polyhedral shape;

a function unit coupled to at least one of the plurality of side parts in a replaceable manner within the body of the single block having the polyhedral shape;

an application unit arranged in the body of the single block having the polyhedral shape in a replaceable manner and configured to control an operation of the function unit;

a base unit arranged in the body of the single block having the polyhedral shape and configured to provide an application support function to the application unit;

a power supply unit arranged in the body of the single block having the polyhedral shape and configured to supply electric power to at least one of the function unit, the application unit, or the base unit;

at least one knob for coupling the base unit to the top part;

at least one first supporter for coupling the application unit to the base unit; and at least one second supporter for coupling the power supply unit to the application unit, wherein the function unit or the application unit is configured to be replaced with a different function unit or a different application unit within the body of the single block having the polyhedral shape by separating the plurality of side parts from the body of the single block having the polyhedral shape, the power supply unit is coupled to the bottom part, the power supply unit, the application unit, and the base unit are stacked in a layered manner from the bottom part to the top part, the at least one first supporter is coupled with a groove in the application unit, and separates the application unit from the base unit; and the at least one second supporter is coupled with a groove in the power supply unit, and separates the application unit from the power supply unit.

2. The smart toy platform according to claim 1, wherein the application unit and the base unit are connected to each other with at least one of a power supply line and a data transmission line, and the application support function includes at least one of a power supply function or a communication function.

3. The smart toy platform according to claim 1, wherein each of the top part, the bottom part, and the plurality of side parts has a geometric shape, and the plurality of side parts are configured to be coupled between the top part and the bottom part to form the polyhedral shape of the body.

4. The smart toy platform according to claim 1, wherein the function unit includes at least one of an imaging module, a sound output module, a light emitting module, a sensor module, an actuator module, a display module, or an input module.

5. The smart toy platform according to claim 1, wherein the top part includes a first coupling element for coupling two or more smart toy platforms, and the bottom part includes a second coupling element corresponding to the first coupling element.

6. The smart toy platform according to claim 1, wherein each of the plurality of side parts has fitting grooves and fitting projections for assembling the body.

* * * * *